US009937719B2

(12) United States Patent
Kato et al.

(10) Patent No.: US 9,937,719 B2
(45) Date of Patent: Apr. 10, 2018

(54) INK-JET HEAD

(71) Applicant: BROTHER KOGYO KABUSHIKI KAISHA, Nagoya-shi Aichi-ken (JP)

(72) Inventors: Yasuo Kato, Aichi-ken (JP); Kyohei Naito, Nagoya (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/424,990

(22) Filed: Feb. 6, 2017

(65) Prior Publication Data

US 2017/0274649 A1 Sep. 28, 2017

(30) Foreign Application Priority Data

Mar. 23, 2016 (JP) ..... 2016-058653

(51) Int. Cl.

| | |
|---|---|
| ***B41J 2/145*** | (2006.01) |
| ***B41J 2/155*** | (2006.01) |
| ***B41J 2/14*** | (2006.01) |

(52) U.S. Cl.

CPC ..... *B41J 2/145* (2013.01); *B41J 2/1433* (2013.01); *B41J 2/155* (2013.01); *B41J 2202/20* (2013.01); *B41J 2202/21* (2013.01)

(58) Field of Classification Search

CPC . B41J 2/145; B41J 2/155; B41J 2/1433; B41J 2202/21; B41J 2202/20

See application file for complete search history.

(56) References Cited

U.S. PATENT DOCUMENTS 6,299,675 B1 * 10/2001 Ono ..... B41J 2/2114 106/31.27
2006/0103691 A1 * 5/2006 Dietl ..... B41J 2/1404 347/40
2015/0042724 A1 2/2015 Enomoto et al.

FOREIGN PATENT DOCUMENTS

JP 2015-033837 A 2/2015
JP 2015-039804 A 3/2015

* cited by examiner

*Primary Examiner* — Geoffrey Mruk
(74) *Attorney, Agent, or Firm* — Scully, Scott, Murphy & Presser, P.C.

(57) ABSTRACT

There is provided an ink-jet head including: first and second head chips each formed with two first nozzle arrays extending in a first direction, each of the first nozzle arrays including first nozzles corresponding to a first ink, second nozzles corresponding to a second ink, and third nozzles corresponding to a third ink; third and fourth head chips each formed with two third nozzle arrays extending in the first direction, each of the third nozzle arrays including fourth nozzles corresponding to the fourth ink. The first head chip to the fourth head chip are arranged in parallel in a second direction orthogonal to the first direction.

18 Claims, 18 Drawing Sheets

INK-JET HEAD

CROSS REFERENCE TO RELATED APPLICATION

The present application claims priority from Japanese Patent Application No. 2016-058653 filed on Mar. 23, 2016, the disclosure of which is incorporated herein by reference in its entirety.

BACKGROUND

Field of the Invention

The present invention relates to an ink-jet head.

Description of the Related Art

An ink-jet head (liquid jetting head) used in an ink-jet type printing apparatus includes piezoelectric elements, channels through which ink passes, and nozzles communicating with the channels and from which the ink is jetted. The channels are typically formed by joining a nozzle plate formed with the nozzles, a channel substrate formed with pressure generation chambers to which pressure caused by deformation of the piezoelectric elements is transmitted, and a communication plate formed with communication holes that allow the nozzles to communicate with the pressure generation chambers.

As the above-described ink-jet head, there is known a liquid jetting head in which two head chips are arranged in parallel, each of the head chips including: two nozzle groups formed by nozzles and arranged in a reference direction; a first inlet communicating with one of the nozzle groups; and a second inlet communicating with the other of the nozzle groups. In such a liquid jetting head, channels through which ink flows are formed to allow the first inlet of the head chip to communicate with the second inlet of the head chip.

SUMMARY

According to knowledge of the inventors of the present application, the above-described liquid jetting head, however, still leaves room for improvement in high-density ink jetting.

An object of the present teaching is to provide an ink-jet head that may jet ink more densely than conventional ink-jet heads.

According to an aspect of the present teaching, there is provided an ink jet head configured to jet a first ink, a second ink, a third ink, and a fourth ink, the ink-jet head including:

- a first head chip including two first nozzle arrays extending in a first direction, the first nozzle arrays including first nozzles corresponding to the first ink, second nozzles corresponding to the second ink, and third nozzles corresponding to the third ink;
- a second head chip including two second nozzle arrays extending in the first direction, the second nozzle arrays including first nozzles corresponding to the first ink, second nozzles corresponding to the second ink, and third nozzles corresponding to the third ink;
- a third head chip including two third nozzle arrays extending in the first direction, the third nozzle arrays including fourth nozzles corresponding to the fourth ink; and
- a fourth head chip including two fourth nozzle arrays extending in the first direction, the fourth nozzle arrays including fourth nozzles corresponding to the fourth ink, wherein the first head chip to the fourth head chip are arranged side by side in a second direction orthogonal to the first direction.

Accordingly, it is possible to form, by using only the four head chips, the ink-jet head that jets the first, second, third inks as well as the fourth ink densely.

DESCRIPTION OF THE EMBODIMENTS

In the following, an explanation will be made about specific examples of embodiments with reference to drawings. The present teaching, however, is not limited to the embodiments described below.

First Embodiment

<Configuration of Ink-Jet Printer>

Figure 1:
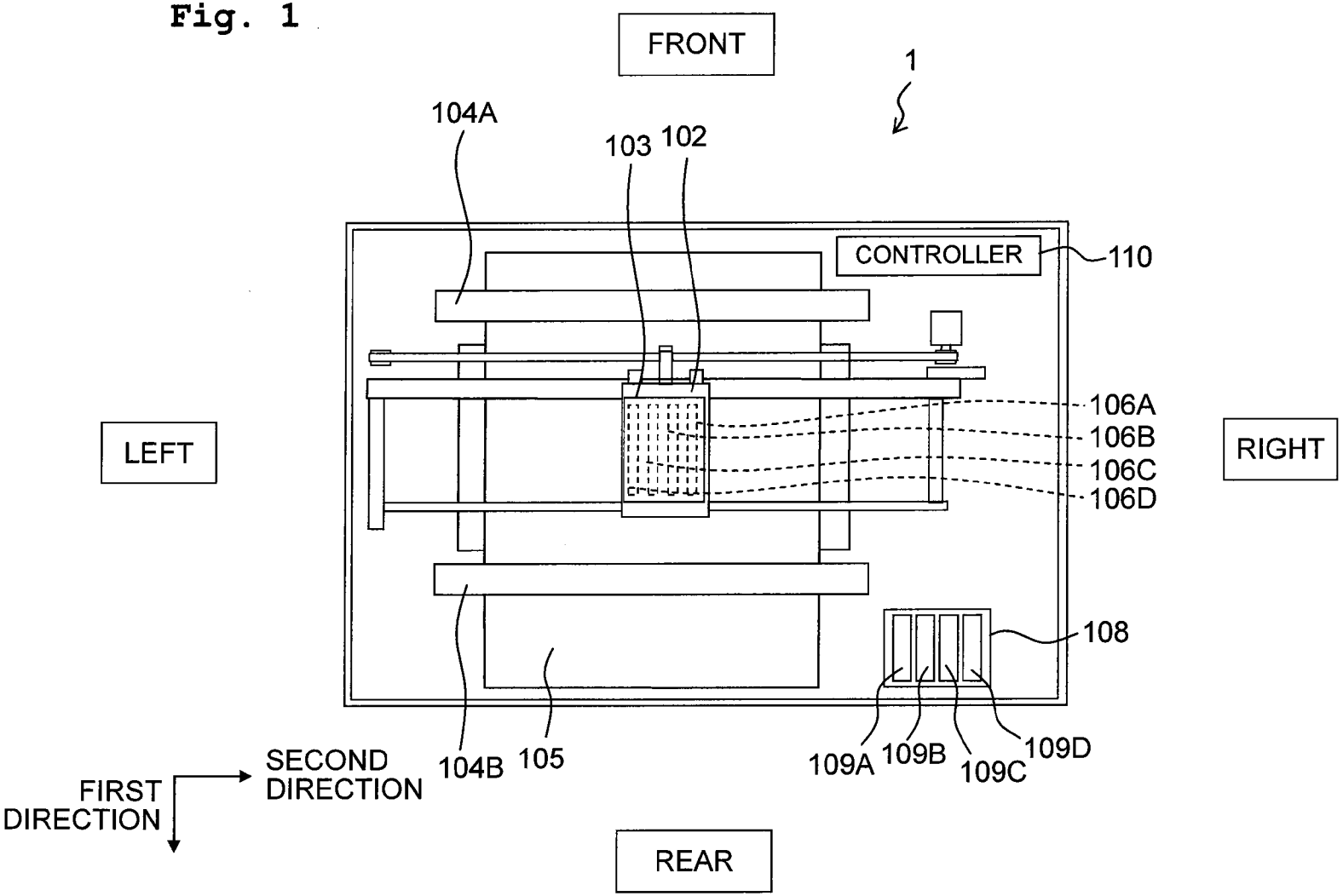
FIG. 1 depicts a schematic configuration of an ink jet printer according to a first embodiment.

A front-rear direction and left-right direction indicated in FIG. 1 correspond to a front-rear direction and left-right direction of an ink-jet printer 1 according to a first embodiment.

As depicted in FIG. 1, the ink jet printer 1 according to the first embodiment includes a carriage 102 that is movable in a scanning direction, i.e., a second direction in FIG. 1; an ink jet head 103 provided in the carriage 102; conveyance rollers 104A and 104B; and a controller 110. The conveyance rollers 104A and 104B convey a recording sheet 105 in a conveyance direction orthogonal to the second direction, i.e., a first direction in FIG. 1.

The ink jet printer 1 includes a cartridge holder 108 to which ink cartridges 109A to 109D for four kinds of inks (black, yellow, cyan, and magenta inks) are installed. The cartridge holder 108 is connected to the ink-jet head 103 via unillustrated tubes.

The ink jet head 103 includes head chips 106A to 106D. The head chips 106A and 106B are configured to jet color inks, and the head chips 106C and 106D are configured to jet black ink. When distinctions between the four head chips 106A to 106D are not necessary, the four head chips 106A to 106D will be simply referred to as head chips 106. The four head chips 106 are arranged from the right to the left in the second direction in this order of the head chip 106A, the head chip 106B, the head chip 106C, and the head chip 106D.

The controller 110 includes a CPU, ROM, RAM, EEPROM, ASIC, and the like. When the controller 110 accepts input of a printing job from an external apparatus such as a PC, the controller 110 drives respective drivers, such as an after-mentioned drive IC 71, based on programs stored in the ROM to execute print processing.

In particular, the controller 110 alternately performs an ink jetting operation and a conveyance operation. In the ink jetting operation, inks are respectively jetted from nozzles formed in lower surfaces of the head chips 106A to 106D to the recording sheet 105, while the ink-jet head 103 is moving in the second direction together with the carriage 102. In the conveyance operation, the conveyance rollers 104A. 104B convey the recording sheet 105 in the first direction by a predefined amount. The recording sheet 105 for which the print processing has been performed is conveyed with the conveyance rollers 104A, 104B in the first direction and then discharged on an unillustrated discharge tray.

<Configuration of Head Chip>

An explanation will be made about a configuration of the head chip 106A with reference to FIGS. 2 to 4. The head chip 106B has the same configuration as the head chip 106A, and thus any explanation thereof will be omitted.

Figure 2:
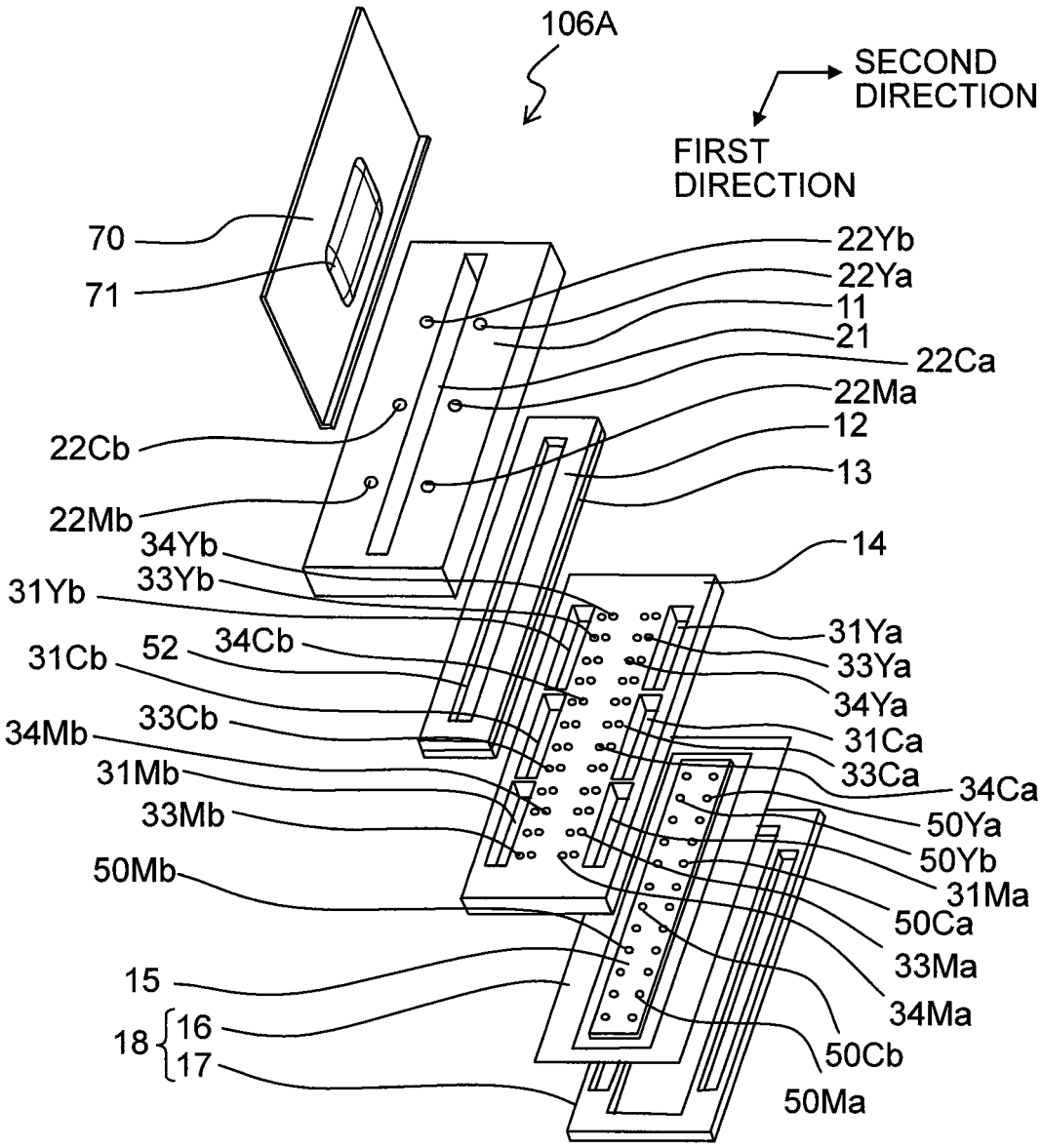
FIG. 2 is an exploded perspective view of a head chip 106A.
Figure 3:
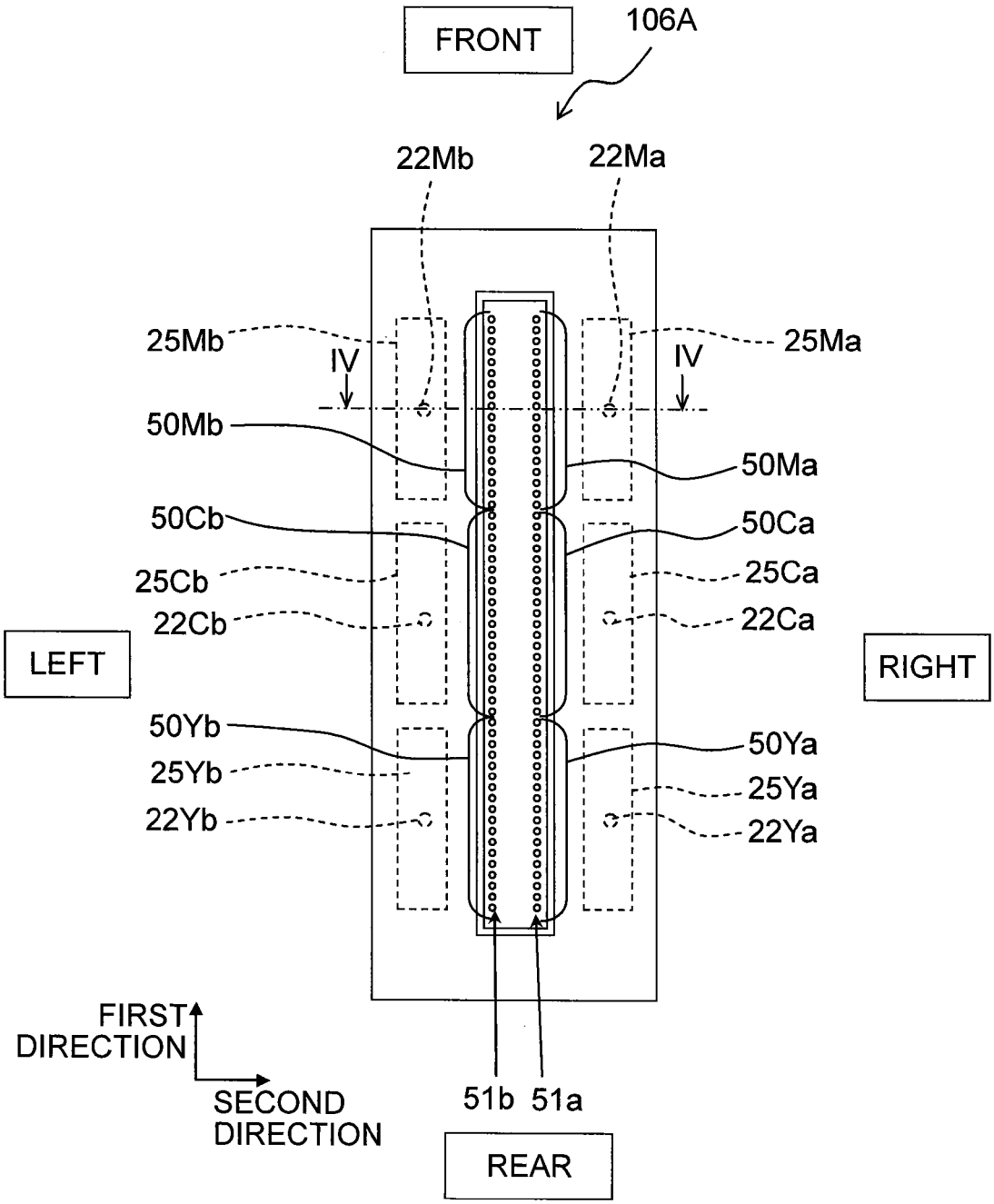
FIG. 3 is a bottom view of the head chip 106A.
Figure 4:
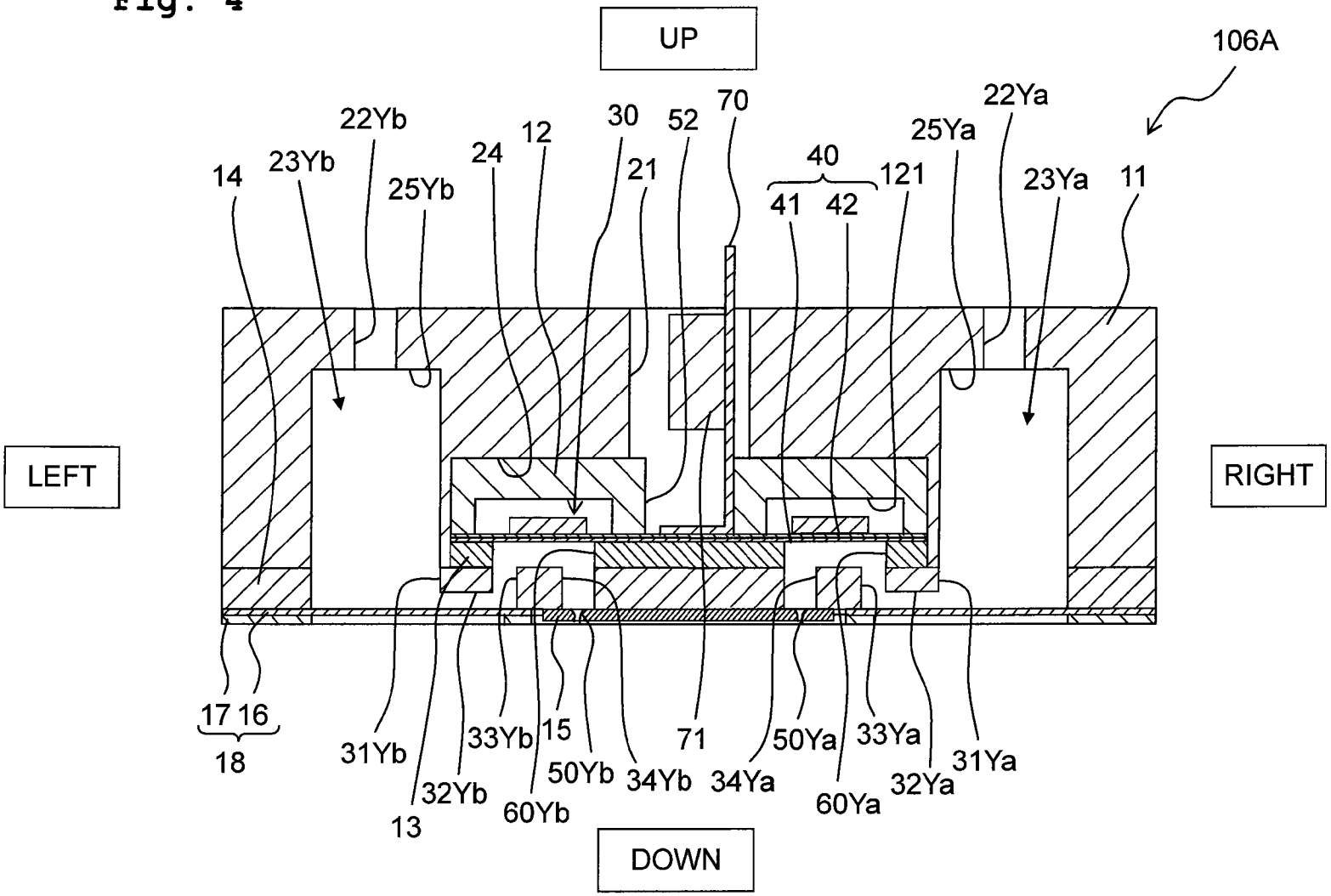
FIG. 4 is a cross-sectional view of the head chip 106A taken along a line IV-IV in FIG. 3.

As depicted in FIGS. 2 to 4, the head chip 106A includes a flexible printed circuit board 70 on which the driver IC 71 is installed, a reservoir formation member 11, a protective substrate 12, an actuator substrate 13, a channel formation substrate 14, a nozzle plate 15, and a compliance substrate 18.

In the following, when an explanation is made with distinctions between the head chips 106A to 106D, components or parts of the head chips 106 and components or parts of the ink-jet head 3 provided for each of the head chips 106 are assigned with reference numerals with alphabetic suffixes of A to D, as with the head chips 106A to 106D. When the distinctions between the head chips 106A to 106D are not necessary, an explanation will be made by using reference numerals with no alphabetic suffixes of A to D. For example, when the flexible printed circuit board described below is explained separately for each of the head chips 106A to 106D, an explanation will be made by using "flexible printed circuit boards 70A to 70D". When the distinctions between the four head chips 106A to 106D are not necessary, an explanation will be made by using "flexible printed circuit boards 70" that is a collective term of "flexible printed circuit boards 70A to 70D". Note that, the alphabetic suffixes of A to D used for distinctions are each added to the end of the reference numeral.

As depicted in FIG. 3, the nozzle plate 15 includes two nozzle arrays 51. The nozzle array 51 arranged on the right in the second direction is referred to as a nozzle array 51*a* and the nozzle array 51 arranged on the left in the second direction is referred to as a nozzle array 51*b*. Namely, the nozzle arrays 51*a*, 51*b* are arranged in parallel in the second direction. The nozzle array 51*a* includes nozzles 50Ya, nozzles 50Ca, and nozzles 50Ma arrayed in the first direction in that order from one side to the other side (from the rear side to the front side) in the first direction. The nozzle array 51*b* includes nozzles 50Yb, nozzles 50Cb, and nozzles 50Mb arrayed in the first direction in that order from one side to the other side (from the rear side to the front side) in the first direction.

The nozzles 50Ya and nozzles 50Yb are nozzles corresponding to the yellow ink that is an exemplary first ink of the present teaching. The nozzles 50Ca and nozzles 50Cb are nozzles corresponding to the cyan ink that is an exemplary second ink of the present teaching. The nozzles 50Ma and nozzles 50Mb are nozzles corresponding to the magenta ink that is an exemplary third ink of the present teaching. Namely, the nozzles 50Ya or the nozzles 50Yb correspond to first nozzles of the present teaching. The nozzles 50Ca or the nozzles 50Cb correspond to second nozzles of the present teaching. The nozzles 50Ma or the nozzles 50Mb correspond to third nozzles of the present teaching.

In the present teaching, channel constituent parts, such as nozzles and pressure chambers provided corresponding to nozzles, will be explained by adding, to each of the reference numerals, a combination of alphabetic letters that depends on an ink color corresponding to the channel and the nozzle array including nozzles that communicate with the channel. In particular, four alphabetic letters of Y, C, M, and Bk are used for reference numerals indicating four kinds of inks. Further, an alphabetic letter "a" is used for reference numerals assigned for the constituent parts arranged on the right in the second direction, and an alphabetic letter "b" is used for reference numerals assigned for the constituent parts arranged on the left in the second direction. When distinctions between ink colors and distinctions between positions in the second direction are unnecessary, an explanation will be made by using reference numerals having no alphabetic letters. For example, when nozzles are not required to be distinguished by ink colors and/or nozzle arrays including them, the nozzles are simply referred to as "nozzles 50".

The nozzle plate 15 may be a single crystal silicon substrate. The nozzle plate 15 may be made from a high polymer synthetic-resin material such as polyimide or a metal material such as stainless steel.

The single crystal silicon channel formation substrate 14 is joined to an upper surface of the nozzle plate 15. In addition to the nozzle plate 15, the compliance substrate 18 is joined to a lower surface of the channel formation substrate 14. The compliance substrate 18 is formed by a sealing film 16 and a fixed substrate 17. The sealing film 16 is a flexible thin film. For example, the sealing film 16 may be a resin film. The fixed substrate 17 is made from a hard material, such as a metal material exemplified by stainless steel and the like.

The actuator substrate 13 is joined to an upper surface of the channel formation substrate 14. As depicted in FIG. 4, a vibration plate 40 is formed on an upper surface side of the actuator substrate 13.

The actuator substrate 13 includes pressure chambers 60Ya, pressure chambers 60Yb, pressure chambers 60Ca, pressure chambers 60Cb, pressure chambers 60Ma, and pressure chambers 60Mb. Each of the pressure chambers 60Ya communicates with the corresponding one of the nozzles 50Ya. Similarly, each of the pressure chambers 60Yb communicates with the corresponding one of the nozzles 50Yb. Each of the pressure chambers 60Ca communicates with the corresponding one of the nozzles 50Ca.

Each of the pressure chambers 60Cb communicates with the corresponding one of the nozzles 50Cb. Each of the pressure chambers 60Ma communicates with the corresponding one of the nozzles 50Ma. Each of the pressure chambers 60Mb communicates with the corresponding one of the nozzles 50Mb. Although illustration of the pressure chambers 60Ca, 60Cb, 60Ma, and 60Mb is omitted, their configurations are the same as that of the pressure chamber 60Ya or that of the pressure chamber 60Yb depicted in FIG. 4.

Through holes 34Ya, through holes 34Yb, through holes 34Ca, through holes 34Cb, through holes 34Ma, and through holes 34Mb are formed in the vicinity of the center of the channel formation substrate 14 in the second direction. Each of the through holes 34 is formed to correspond to one of the nozzles 50. Namely, the number of through holes 34 formed in the channel formation substrate 14 is identical to the number of nozzles 50 formed in the nozzle plate 15. The through holes 34 communicate with the nozzles 50 and the pressure chambers 60 corresponding to the nozzles 50, respectively. For example, each of the through holes 34Ya communicates with the corresponding one of the nozzles 50Ya and the pressure chamber 60Ya that corresponds to the nozzle 50Ya.

Six through holes 31 (through holes 31Ya, 31Yb, 31Ca, 31Cb, 31Ma, and 31Mb) are formed at the outside areas of the channel formation substrate 14 in the second direction. Each of the through holes 31 is a slit-like through hole extending in the first direction. The through holes 31Ya, 31Ca, and 31Ma are arranged in the first direction in that order on the right in the second direction from one side (rear side) to the other side (front side). The through holes 31Yb, 31Cb, and 31Mb are arranged in the first direction in that order on the left in the second direction from one side (rear side) to the other side (front side). The reservoir formation member 11 includes six concave parts 25 corresponding to the six through holes 31, respectively. Each of the through holes 31 communicates with the corresponding one of the concave parts 25. Details of the reservoir formation member 11 and the concave parts 25 will be described later.

The channel formation substrate 14 includes through holes 33Ya, through holes 33Yb, through holes 33Ca, through holes 33Cb, through holes 33Ma, and through holes 33Mb. The number of through holes 33 is identical to the number of nozzles 50. Each of the through holes 33 is formed between the corresponding one of the through holes 34 and the corresponding one of the through holes 31. For example, each of the through holes 33Ya is formed between the corresponding one of the through holes 34Ya and the through hole 31Ya.

The channel formation substrate 14 includes six concave parts 32 (six concave parts 32Ya, 32Yb, 32Ca, 32Cb, 32Ma, and 32Mb). The six concave parts 32 are formed by half etching from a lower surface side of the channel formation substrate 14. Each of the concave parts 32 is arranged between the corresponding one of the slit-like through holes 31 and the through holes 33 to form a common channel connecting the through hole 31 and the through holes 33. For example, as depicted in FIG. 4, the concave part 32Ya is formed to connect the through holes 33Ya and the through hole 31Ya. The slit-like through hole 31Ya is connected to the pressure chambers 60Ya via the concave part 32Ya and the through holes 33Ya. Similarly, the concave part 32Yb is formed to connect the through holes 33Yb and the through hole 31Yb. The concave part 32Ca is formed to connect the through holes 33Ca and the through hole 31Ca. The concave part 32Cb is formed to connect the through holes 33Cb and the through hole 31Cb. The concave part 32Ma is formed to connect the through holes 33Ma and the through hole 31Ma. The concave part 32Mb is formed to connect the through holes 33Mb and the through hole 31Mb.

The vibration plate 40 formed on the upper side of the actuator substrate 13 includes an elastic film 41 and an insulator film 42 disposed on an upper surface of the elastic film 41. For example, the elastic film 41 may be an oxide film that is formed on a surface of a silicon substrate by heating of the silicon substrate. In that case, the elastic film 41 is $SiO_2$. Further, the insulator film 42 may be $ZrO_2$. The piezoelectric elements 30 are provided on an upper surface of the insulator film 42 while corresponding to the pressure chambers 60, respectively. The piezoelectric elements 30 are arranged in two arrays while corresponding to the two nozzle arrays 51*a* and 51*b*. Each of the piezoelectric elements 30 is formed by a common electrode, a piezoelectric layer, and an individual electrode. The common electrode may be made from a conductive material. For example, the common electrode may be made from platinum.

The piezoelectric layer is formed on an upper surface of the common electrode. The piezoelectric layer may be made from, for example, lead titanate zirconate or lead titanate zirconate niobate containing silicon. The individual electrode is formed on an upper surface of the piezoelectric layer. The individual electrode may be made from a conductive material, such as iridium or aluminum.

The common electrode and individual electrodes are connected to connection terminals of the flexible printed circuit board 70 via unillustrated wires. This allows the drive IC 71 to control electrical potentials of the individual electrodes via the wires.

The protective substrate 12 is joined to an upper surface of the vibration plate 40. A lower surface of the protective substrate 12 includes two concave parts 121. Each of the concave parts 121 is formed to extend, in the second direction, across an array of the pressure chambers 30. Each of the concave parts 121 contains an array of the piezoelectric elements 30.

The reservoir formation member 11 made from resin is joined to the periphery of the upper surface of the channel formation substrate 14. A concave part 24 is formed in a center part of a lower surface of the reservoir formation member 11. The protective substrate 12, the piezoelectric elements 30, and the vibration plate 40 are placed in the concave part 24.

A slit-like connection port 21 extending in the first direction is provided in a center part of an upper surface of the reservoir formation member 11. The connection port 21 communicates with a slit-like through hole 52 formed in the protective substrate 12. The flexible printed circuit board 70 is placed to put through the connection port 21 and the through hole 52.

As depicted in FIG. 3, three convex parts 25Ya, 25Ca, and 25Ma, which are arrayed in the first direction, are provided on one end side (right side) of the reservoir formation member 11 in the second direction. Three convex parts 25Yb, 25Cb, and 25Mb, which are arrayed in the first direction, are provided on the other end side (left side) of the reservoir formation member 11 in the second direction. Each of the six concave parts 25 is formed to extend in the first direction. Each of the six concave parts 25 is formed on a lower surface side of the reservoir formation member 11. Each of the six concave parts 25 communicates with the corresponding one of the slit-like through holes 31. In particular, the concave part 25Ya communicates with the through hole 31Ya; the concave part 25Yb communicates with the through hole 31Yb; the concave part 25Ca communicates with the through hole 31Ca; the concave part 25Cb communicates with the through hole 31Cb; the concave part 25Ma communicates with the through hole 31Ma; and the concave part 25Mb communicates with the through hole 31Mb.

In the following explanation, a common channel formed by the concave part 25Ya, the through hole 31Ya, and the concave part 32Ya is referred to as a reservoir 23Ya; a common channel formed by the concave part 25Yb, the through hole 31Yb, and the concave part 32Yb is referred to as a reservoir 23Yb; a common channel formed by the concave part 25Ca, the through hole 31Ca, and the concave part 32Ca is referred to as a reservoir 23Ca; a common channel formed by the concave part 25Cb, the through hole 31Cb, and the concave part 32Cb is referred to as a reservoir 23Cb; a common channel formed by the concave part 25Ma, the through hole 31Ma, and the concave part 32Ma is referred to as a reservoir 23Ma; and a common channel formed by the concave part 25Mb, the through hole 31Mb, and the concave part 32Mb is referred to as a reservoir 23Mb. When the respective reservoirs do not need distinctions based on arrangement positions and/or ink colors, they are simply referred to as "reservoirs 23".

The upper surface of the reservoir formation member 11 includes inlets 22Ya and 22Yb arranged to face each other with the connection port 21 sandwiched therebetween. The inlet 22Ya communicates with the reservoir 23Ya and the inlet 22Yb communicates with the reservoir 23Yb.

The upper surface of the reservoir formation member 11 includes inlets 22Ca and 22Cb arranged to face each other with the connection port 21 sandwiched therebetween. The inlet 22Ca communicates with the reservoir 23Ca and the inlet 22Cb communicates with the reservoir 23Cb.

The upper surface of the reservoir formation member 11 includes inlets 22Ma and 22Mb arranged to face each other with the connection port 21 sandwiched therebetween. The inlet 22Ma communicates with the reservoir 23Ma and the inlet 22Mb communicates with the reservoir 23Mb.

Subsequently, a configuration of the head chip 106C will be explained in detail with reference to FIGS. 5 and 6. The head chip 106D has the same configuration as the head chip 106C, and thus any explanation thereof will be omitted.

Figure 5:
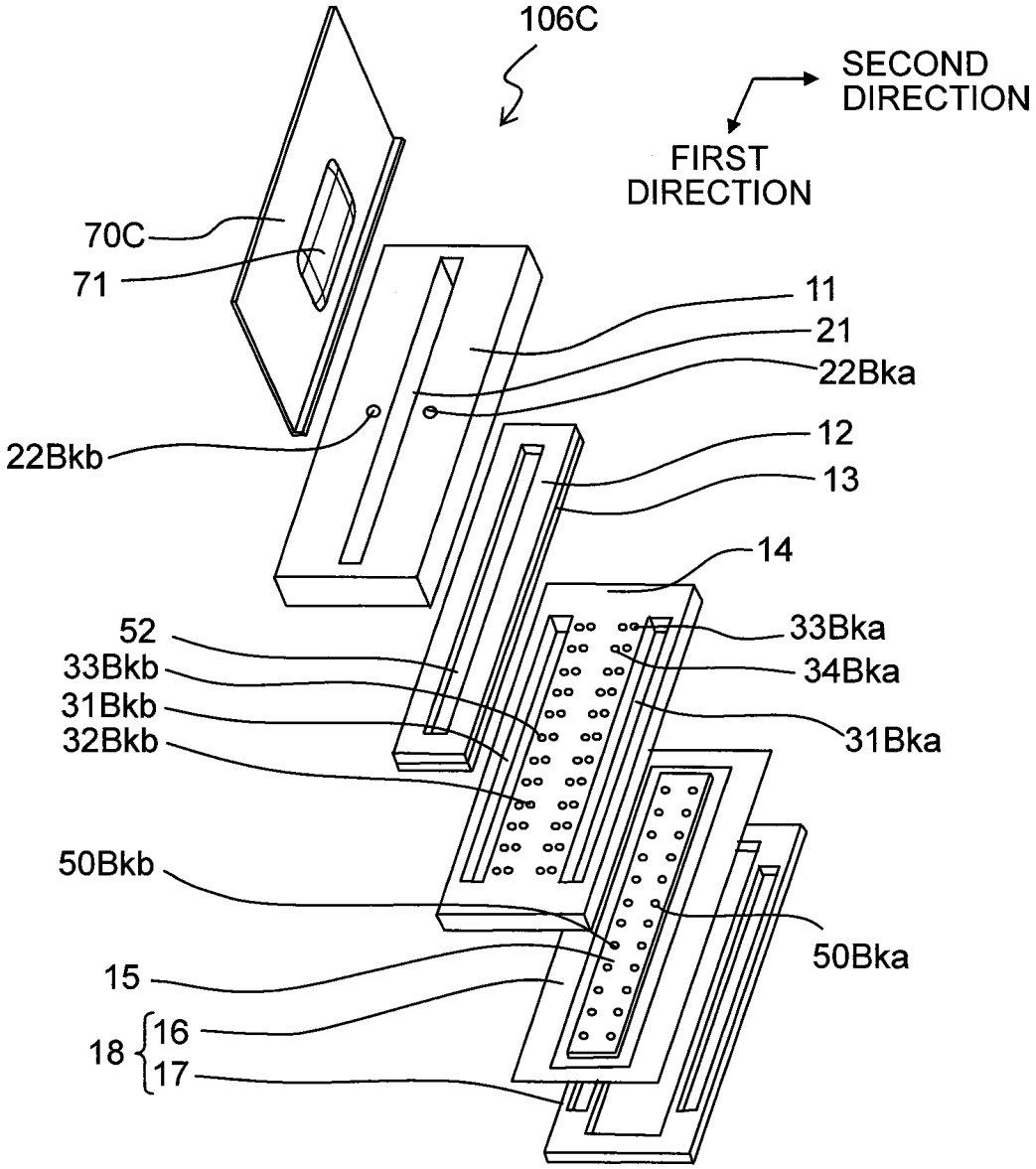
FIG. 5 is an exploded perspective view of a head chip 106C.
Figure 6:
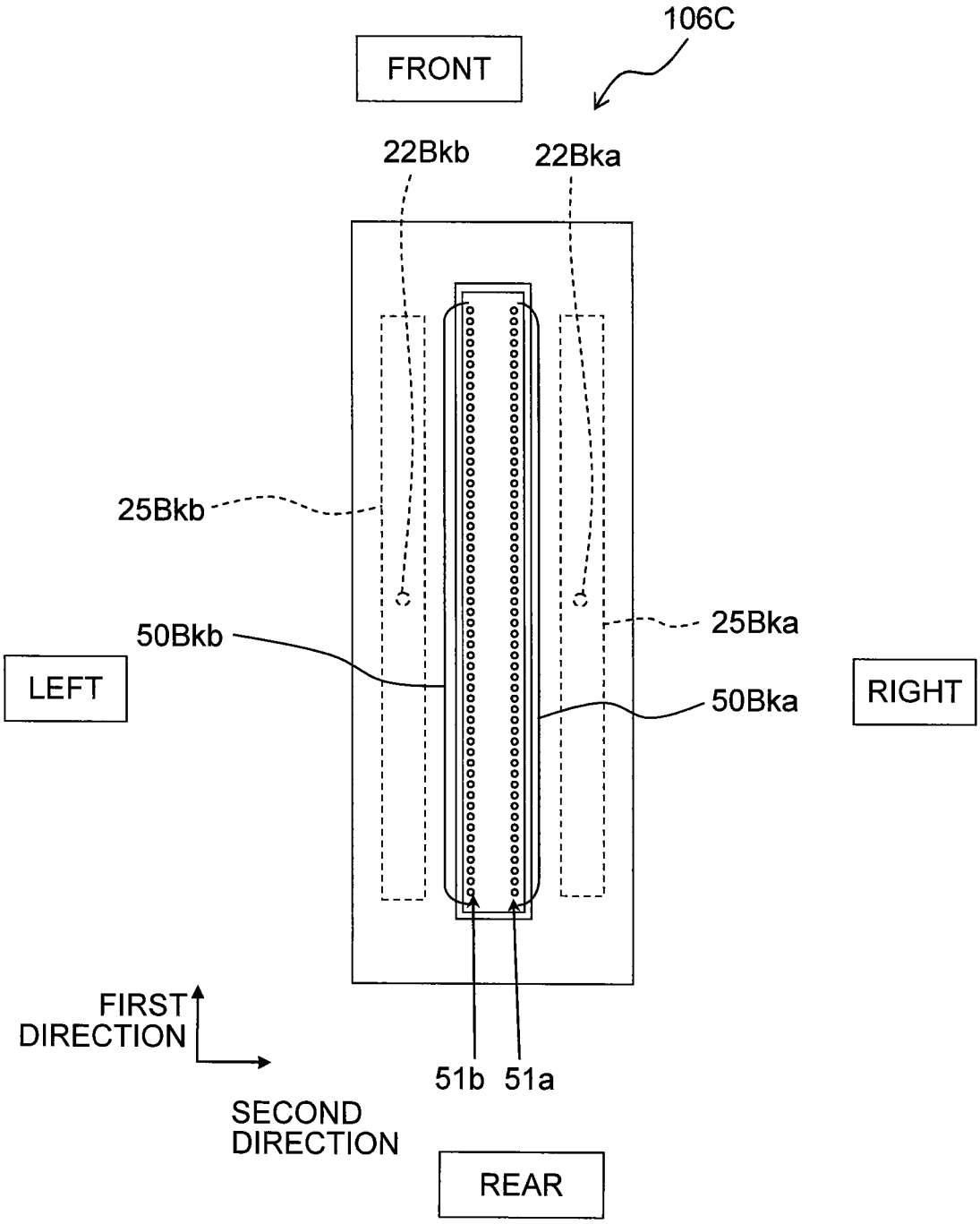
FIG. 6 is a bottom view of the head chip 106C.
Figure 7:
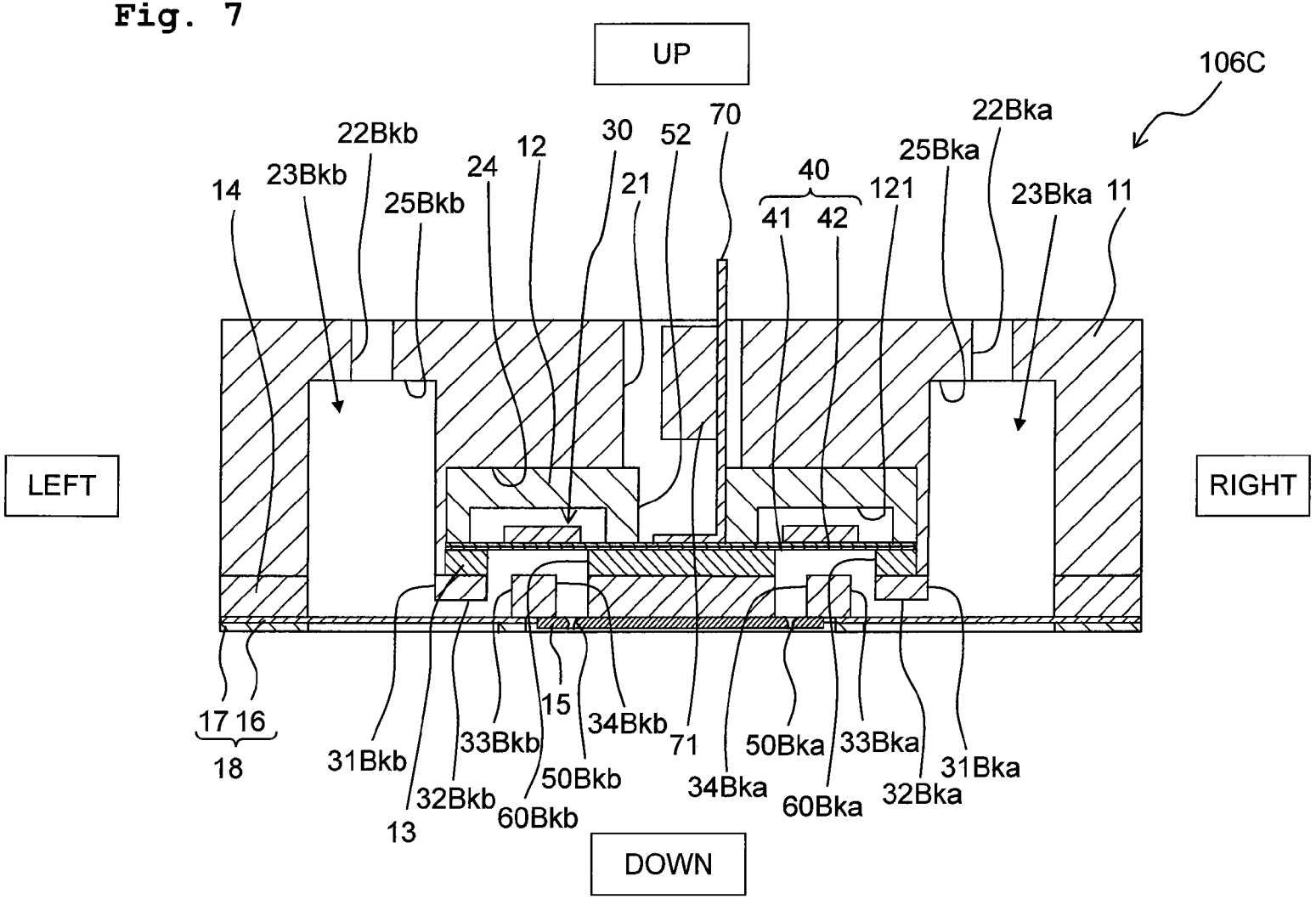
FIG. 7 is a cross-sectional view of the head chip 106C.

As depicted in FIGS. 5 to 7, although the head chip 106C has a basic configuration that is the same as that of the head chip 106A, the head chip 106C is different from the head chip 106A in the following points. In the head chip A, the three reservoirs 23Ya, 23Ca, and 23Ma are formed on one end side of the head chip A in the second direction. In the head chip 106C, a reservoir 23Bka is formed to extend in the first direction on one end side of the head chip 106C in the second direction. Further, a reservoir 23Bkb is formed to extend in the first direction on the other end side of the head chip 106C in the second direction.

The reservoir 23Bka is formed by a concave part 25Bka, a through hole 31Bka, and a concave part 32Bka. The concave part 25Bka is formed, on a lower surface of the reservoir formation member 11 on one end side in the second direction, to extend in the first direction. The through hole 31Bka is formed in the channel formation substrate 14. The concave part 32Bka is formed on the lower surface side of the channel formation substrate 14. Similarly, the reservoir 23Bkb is formed by a concave part 25Bkb, a through hole 31Bkb, and a concave part 32Bkb. The concave part 25Bkb is formed, on the lower surface of the reservoir formation member 11 on the other end side in the second direction, to extend in the first direction. The through hole 31Bkb is formed in the channel formation substrate 14. The concave part 32Bkb is formed on the lower surface side of the channel formation substrate 14.

In the head chip 106C, an upper surface of the reservoir formation member 11 includes inlets 22Bka and 22Bkb arranged to face each other with the connection port 21 sandwiched therebetween. The inlet 22Bka communicates with the reservoir 23Bka and the inlet 22Bkb communicates with the reservoir 23Bkb.

The nozzle plate 15 includes nozzle arrays 51*a* and 51*b* arranged in parallel in the second direction. The nozzle array 51*a* of the head chip 106C is formed by nozzles 50Bka arrayed in the first direction. Similarly, the nozzle array 51*b* of the head chip 106C is formed by nozzles 50Bkb arrayed in the first direction. The nozzles 50Bka and 50Bkb are nozzles corresponding to the black ink that is an exemplary fourth ink of the present teaching.

The channel formation substrate 14 includes through holes 33Bka connecting the concave part 32Bka and pressure chambers 60Bka, and through holes 33Bkb connecting the concave part 32Bkb and pressure chambers 60Bkb. Further, the channel formation substrate 14 includes through holes 34Bka connecting the pressure chambers 60Bka and the nozzles 50Bka, and through holes 34Bkb connecting the pressure chambers 60Bkb and the nozzles 50Bkb.

Each of the head chips 106A to 106D includes the nozzle array 51*a* that is the right-side nozzle array 51 and the nozzle array 51*b* that is the left-side nozzle array 51. When distinctions between the nozzle arrays 51*a* and 51*b* of the head chips 106A to 106D are necessary, an explanation will be made by using reference numerals with alphabetic suffixes of A to D. Namely, the nozzle arrays 51*a* and 51*b* of the head chip 106A are referred to as nozzle arrays 51*a*A and 51*b*A; the nozzle arrays 51*a* and 51*b* of the head chip 106B are referred to as nozzle arrays 51*a*B and 51*b*B; the nozzle arrays 51*a* and 51*b* of the head chip 106C are referred to as nozzle arrays 51*a*C and 51*b*C; and the nozzle arrays 51*a* and 51*b* of the head chip 106D are referred to as nozzle arrays 51*a*D and 51*b*D.

<Configuration of Ink-Jet Head>

Subsequently, an explanation will be made about a configuration of the ink-jet head 103 with reference to FIGS. 8 to 10.

Figure 9:
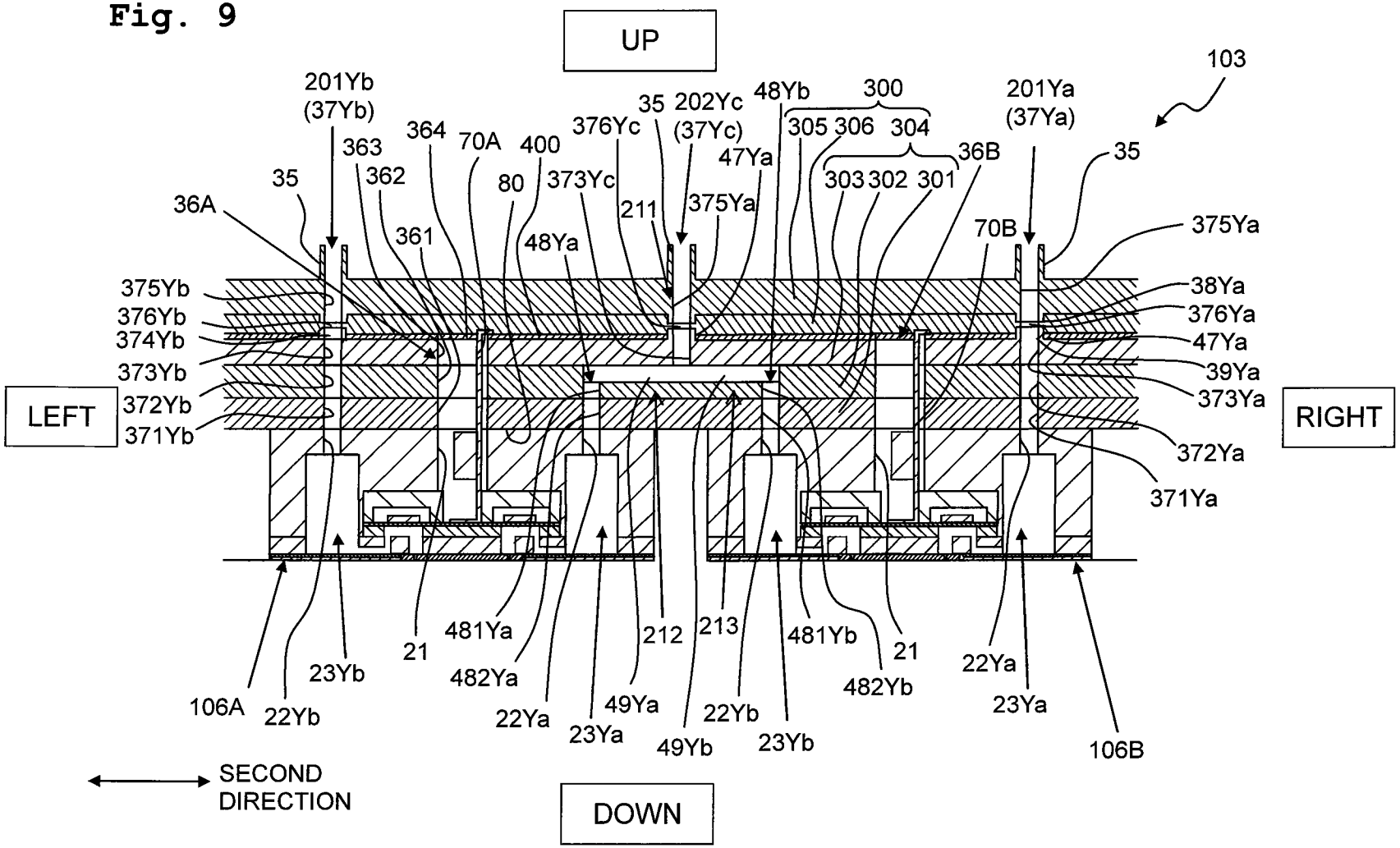
FIG. 9 is a cross-sectional view of the ink-jet head.
Figure 10:
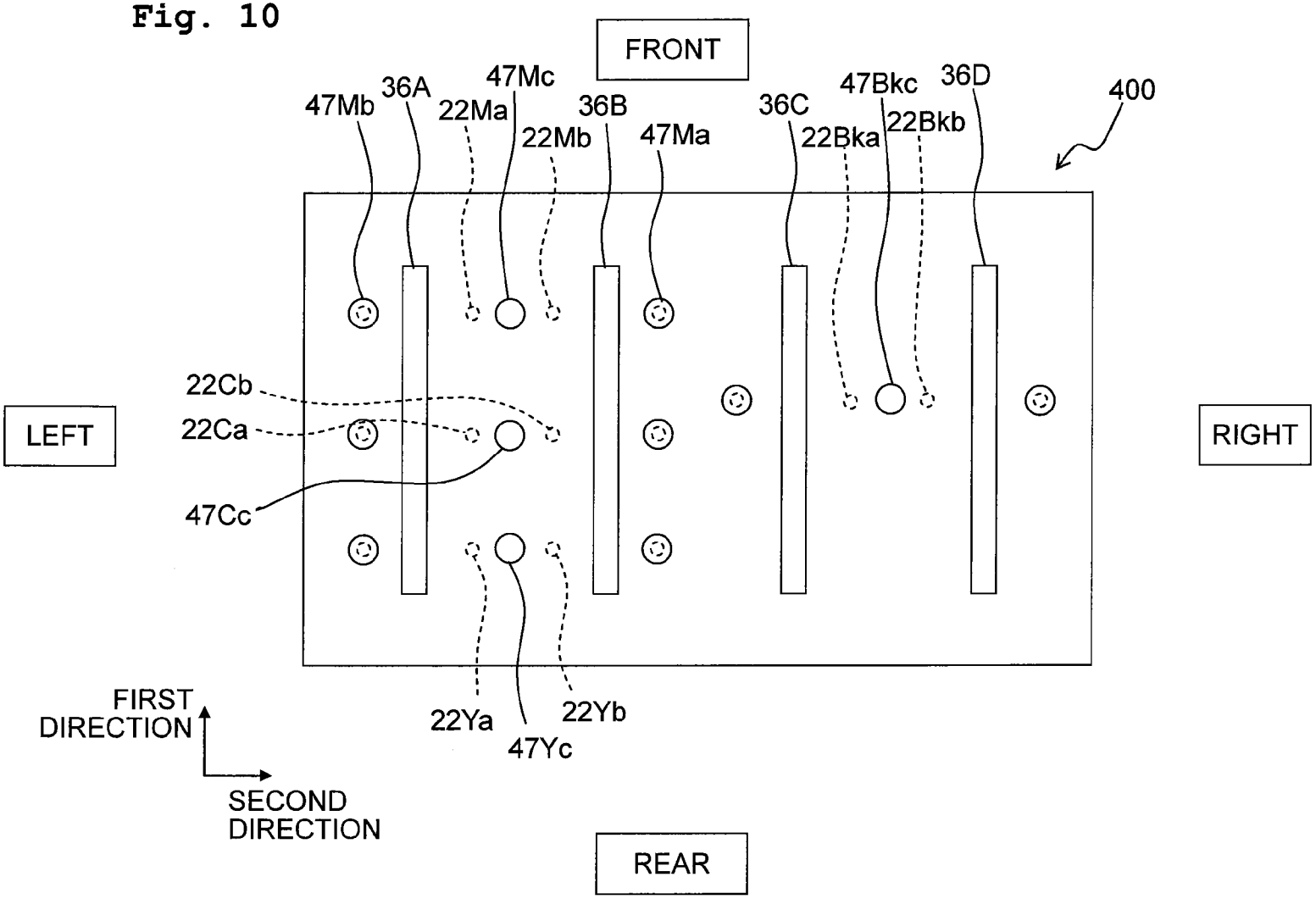
FIG. 10 is a bottom view of a wiring substrate of the ink-jet head.

In FIG. 10, respective inlets are depicted by broken lines. Further, a cross-section taken along a line C-C, a cross-section taken along a line D-D, and a cross-section taken along a line E-E depicted in FIG. 8 are configured similarly to a cross-section taken along a line IX-IX depicted in FIG. 9.

Figure 8:
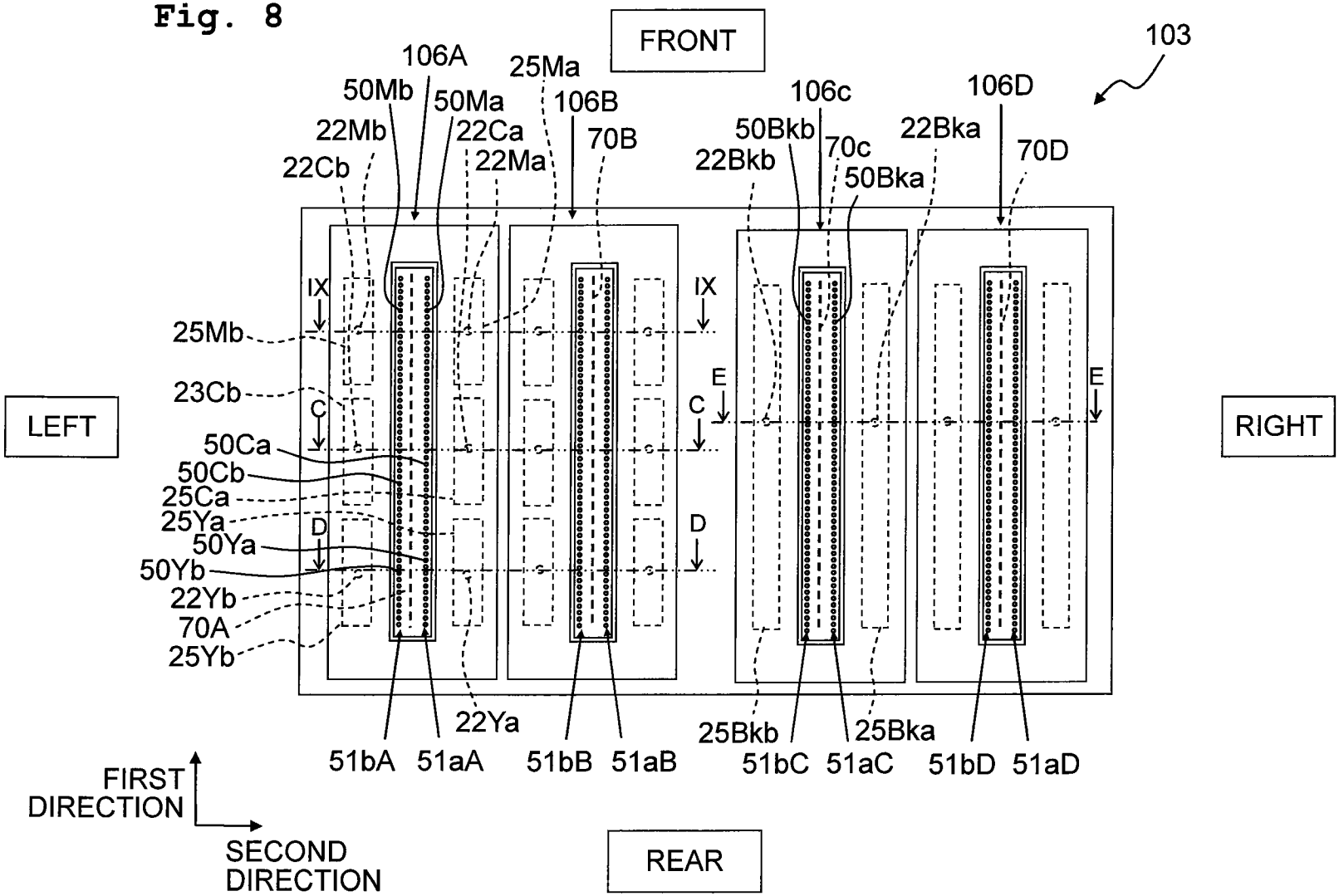
FIG. 8 is a bottom view of an ink-jet head.

As depicted in FIG. 8, the ink-jet head 103 according to the first embodiment includes the head chips 106A, 106B, 106C, and 106D arranged in parallel in the second direction in that order. Namely, the head chips 106A and 106B are arranged to be adjacent to each other, and the head chips 106C and 106D are arranged to adjacent to each other. The head chips 106A and 106B have the same configuration as described above, and thus respective constituent parts of the head chip 106A have the same configurations as respective constituent parts of the head chip 106B. In the following, however, an explanation will be made by using reference numerals with alphabetic suffixes of A and B when it is necessary to distinguish the constituent parts of the head chip 106A and the constituent parts of the head chip 106B. Similarly, respective constituent parts of the head chip 106C have the same configurations as respective constituent parts of the head chip 106D. In the following, however, an explanation will be made by using reference numerals with alphabetic suffixes of C and D when it is necessary to distinguish the constituent parts of the head chip 106C and the constituent part of the head chip 106D.

The head chip 106A includes two nozzle arrays 51*a*A and 51*b*A that are arranged to face each other with the flexible printed circuit board 70A sandwiched therebetween in the second direction. The nozzle array 51*a*A includes nozzles 50YaA corresponding to the yellow ink, nozzles 50CaA corresponding to the cyan ink, and nozzles MaA corresponding to the magenta ink. The nozzle array 51*b*A includes nozzles 50YbA corresponding to the yellow ink, nozzles 50CbA corresponding to the cyan ink, and nozzles 50MbA corresponding to the magenta ink. The head chip 106B includes two nozzle arrays 51*a*B and 51*b*B that are arranged to face each other with the flexible printed circuit board 70B sandwiched therebetween in the second direction. The nozzle array 51*a*B includes nozzles 50YaB corresponding to the yellow ink, nozzles 50CaB corresponding to the cyan ink, and nozzles MaB corresponding to the magenta ink. The nozzle array 51*b*B includes nozzles 50YbB corresponding to the yellow ink, nozzles 50CbB corresponding to the cyan ink, and nozzles 50MbB corresponding to the magenta ink. The head chip 106C includes two nozzle arrays 51*a*C and 51*b*C that are arranged to face each other with the flexible printed circuit board 70C sandwiched therebetween in the second direction. The nozzle array 51*a*C includes nozzles 50BkaC corresponding to the black ink. The nozzle array 51*b*C includes nozzles 50BkbC corresponding to the black ink. The head chip 106D includes two nozzle arrays 51*a*D and 51*b*D that are arranged to face each other with the flexible printed circuit board 70D sandwiched therebetween in the second direction. The nozzle array 51*a*D includes nozzles 50BkaD corresponding to the black ink. The nozzle array 51*b*D includes nozzles 50BkbD corresponding to the black ink.

In order to allow one nozzle array to form an image of 250 to 400 dpi, in each of the eight nozzle arrays 51 including nozzles 50, nozzles adjacent to each other in the first direction are arranged to be separated by a distance P. The nozzles 50 arranged in the same head chip 106 are positioned such that the nozzle array 51*a* is shifted from the nozzle array 51*b* in the first direction by a distance ½P. Further, the nozzle arrays 51 of the head chip 106A are positioned to be shifted from the nozzle arrays 51 of the head chip 106B in the first direction by a distance ¼P, and the nozzle arrays 51 of the head chip 106C are positioned to be shifted from the nozzle arrays 51 of the head chip 106D in the first direction by the distance ¼P.

Namely, in the present embodiment, the ink-jet head 103 includes the four nozzle arrays 51 that are arranged to be shifted from each other by ¼P for each kind of ink, thus forming an image of 1,000 to 1,600 dpi while the carriage 102 moves from one end to the other end in the second direction.

As depicted in FIG. 9, the ink-jet head 103 includes a channel member 300 and a wiring substrate 400. The channel member 300 includes a downstream channel member 304, an upstream channel member 305, and a sealing member 306. The downstream channel member 304 is formed by downstream channel members 301, 302, and 303. The sealing member 306 is disposed between the downstream channel member 304 and the upstream channel member 305.

The downstream channel members 301, 302, and 303 are stacked on top of each other in that order. The wiring substrate 400 is disposed on an upper side of the downstream channel member 303. The upstream channel member 305 is disposed above the wiring substrate 400 with the sealing member 306 sandwiched therebetween.

The four head chips 106A to 106D are joined to a lower surface 80 of the downstream channel member 301. Four through holes 36A to 36D are formed in the downstream channel member 304 and the wiring substrate 400 while corresponding to the four head chips 106A to 106D, respectively. Each of the four through holes 36 is formed by a through hole 364 formed in the wiring substrate 400, a through hole 363 formed in the downstream channel member 303, a through hole 362 formed in the downstream channel member 302, and a through hole 361 formed in the downstream channel member 301.

The through hole 36A communicates with the connection port 21 of the head chip 106A, the through hole 36B communicates with the connection port 21 of the head chip 106B, the through hole 36C communicates with the connection port of the head chip 106C, and the through hole 36D communicates with the connection port of the head chip 106D. Each of the flexible printed circuit boards 70 puts through the corresponding one of the through holes 36.

For example, the flexible printed circuit board 70A of the head chip 106A puts through the through hole 36A, and the flexible printed circuit board 70B of the head chip 106B puts through the through hole 36B. One end, of each flexible printed circuit board 70, on the side opposite to the head chip 106 is connected to terminals arranged on an upper surface of the wiring substrate 400.

In the upper surface of the upstream channel member 305, three cylindrical connection parts 35 protruding upward are provided for each of the four kinds of inks. Namely, 12 cylindrical connection parts 35 in all are formed, and each of the connection parts 35 is connected to the corresponding one of the ink cartridges 109A to 109D via channels including an unillustrated filter chamber, tube, and the like.

Of the three connection parts 35 corresponding to the yellow ink, the connection part 35 arranged at the rightmost side in the second direction is referred to as a connection part 35Ya, the connection part 35 arranged at the leftmost side in the second direction is referred to as a connection part 35Yb, and the connection part 35 arranged between the connection parts 35Ya and 35Yb is referred to as a connection part 35Yc. Of the three connection parts 35 corresponding to the cyan ink, the connection part 35 arranged at the rightmost side in the second direction is referred to as a connection part 35Ca, the connection part 35 arranged at the leftmost side in the second direction is referred to as a connection part 35Cb, and the connection part 35 arranged between the connection parts 35Ca and 35Cb is referred to as a connection part 35Cc. Of the three connection parts 35 corresponding to the magenta ink, the connection part 35 arranged at the rightmost side in the second direction is referred to as a connection part 35Ma, the connection part 35 arranged at the leftmost side in the second direction is referred to as a connection part 35Mb, and the connection part 35 arranged between the connection parts 35Ma and 35Mb is referred to as a connection part 35Mc. Of the three connection parts 35 corresponding to the black ink, the connection part 35 arranged at the rightmost side in the second direction is referred to as a connection part 35Bka, the connection part 35 arranged at the leftmost side in the second direction is referred to as a connection part 35Bkb, and the connection part 35 arranged between the connection parts 35Bka and 35Bkb is referred to as a connection part 35Bkc.

The channel member 300 is formed with ink channels 201Ya, 201Yb, and 201Yc as yellow ink channels. An upstream side of each of the three ink channels 201Ya, 201Yb, and 201Yc communicates with an internal space of the corresponding one of the connection ports 35. Namely, the ink channel 201Ya communicates with the internal space of the connection port 35Ya, the ink channel 201Yb communicates with the internal space of the connection port 35Yb, and the ink channel 201Yc communicates with the internal space of the connection port 35Yc.

A downstream side of the ink channel 201Ya communicates with the inlet 22Ya of the head chip 106B. A downstream side of the ink channel 201Yb communicates with the inlet 22Yb of the head chip 106A. A downstream side of the ink channel 201Yc communicates with two inlets 22, the inlet 22Yb of the head chip 106B and the inlet 22Ya of the head chip 106A.

More specifically, the ink channel 201Ya is defined by a through hole 37Ya formed in the upstream channel member 305, the sealing member 306, and the downstream channel member 304. The through hole 37Ya is formed by a through hole 375Ya formed in the upstream channel member 305, a through hole 376Ya formed in the sealing member 306, a through hole 373Ya formed in the downstream channel member 303, a through hole 372Ya formed in the downstream channel member 302, and a through hole 371Ya formed in the downstream channel member 301. A ring-shaped protrusion 38Ya is formed in the vicinity of a lower end of the through hole 375Ya. In the wiring substrate 400, a through hole 47*a* having an opening area larger than that of the through hole 37Ya is formed. A ring-shaped protrusion 39Ya is formed in the vicinity of an upper end of the through hole 373Ya. The protrusion 39Ya is formed to penetrate through the through hole 47Ya. Concave parts, into which the protrusions 38Ya and 39Ya are fitted, are formed on both surfaces of the sealing member 306. Fitting the protrusions 38Ya and 39Ya into the concave parts of the sealing member 306 prevents ink passing through the ink channel 201Ya from leaking to the outside.

The ink channel 201Yb has the same configuration as the ink channel 201Ya. The ink channel 201Yb is defined by a through hole 37Yb formed in the upstream channel member 305, the sealing member 306, and the downstream channel member 304 to communicate with the inlet 22Yb of the head chip 106A. The through hole 37Yb is formed by a through hole 375Yb formed in the upstream channel member 305, a through hole 376Yb formed in the sealing member 306, a through hole 373Yb formed in the downstream channel member 303, a through hole 372Yb formed in the downstream channel member 302, and a through hole 371Yb formed in the downstream channel member 301. A ring-shaped protrusion 38Yb is formed in the vicinity of a lower end of the through hole 375Yb. In the wiring substrate 400, a through hole 47Yb having an opening area larger than that of the through hole 37Yb is formed. A ring-shaped protrusion 39Yb is formed in the vicinity of an upper-surface side end of the through hole 373Ya. The protrusion 39Yb is formed to penetrate through the through hole 47Yb. Concave parts, into which the protrusions 38Yb and 39Yb are fitted, are formed on both surfaces of the sealing member 306. Fitting the protrusions 38Yb and 39Yb into the concave parts of the sealing member 306 prevents ink passing through the ink channel 201Yb from leaking to the outside.

The ink channel 201Yc includes a common channel 211 and branch channels 212, 213. The common channel 211 is formed to run through the through hole 47Yc formed in the wiring substrate 400. The branch channels 212, 213 branch off from the common channel 211 in the downstream channel member 304.

The branch channel 212 communicates with the inlet 22Ya of the head chip 106A. The branch channel 212 is formed by a through hole 48Ya and a groove 49Ya. The through hole 48Ya is formed in the downstream channel members 301 and 302. The groove 49Ya is formed in an upper surface of the downstream channel member 302 to communicate with the through hole 48Ya. The through hole 48Ya is formed by a through hole 481Ya formed in the downstream channel member 301 and a through hole 482Ya formed in the downstream channel member 302.

The branch channel 213 communicates with the inlet 22Yb of the head chip 106B. The branch channel 213 is formed by a through hole 48Yb and a groove 49Yb. The through hole 48Yb is formed in the downstream channel members 301 and 302. The groove 49Yb is formed in an upper surface of the downstream channel member 302 to communicate with the through hole 48Yb. The through hole 48Yb is formed by a through hole 481Yb formed in the downstream channel member 301 and a through hole 482Yb formed in the downstream channel member 302.

The common channel 211 is defined by a through hole 37Yc formed in the upstream channel member 305, the sealing member 306, and the downstream channel member 303. The through hole 37Yc is formed by a through hole 375Yc formed in the upstream channel member 305, a through hole 376Yc formed in the sealing member 306, and a through hole 373Yc formed in the downstream channel member 303.

The wiring substrate 400 includes the through hole 47Yc through which the common channel 211 runs. The vicinity of the through hole 47Yc of the wiring substrate 400 formed with the common channel 211 has the same configuration as the vicinity of the through hole 47Yc of the ink channel 201Ya. A ring-shaped protrusion 38Yc is formed in the vicinity of a lower end of the through hole 375Yc. The through hole 47Yc of the wiring substrate 400 has an opening area larger than that of the through hole 37Yc. A ring-shaped protrusion 39Yc is formed in the vicinity of an upper-surface side end of the through hole 373Yc. The protrusion 39Yc is formed to penetrate through the through hole 47Yc. Concave parts, into which the protrusions 38Yc and 39Yc are fitted, are formed on both surfaces of the sealing member 306. Fitting the protrusions 38Yc and 39Yc into the concave parts of the sealing member 306 prevents ink passing through the common channel 211 from leaking to the outside.

In the above description, the ink channels 201Ya, 201Yb, and 201Yc through which the yellow ink flows are explained. In addition to the ink channels 201Ya, 201Yb, and 201Yc, the ink jet head 103 includes ink channels 201Ca, 201Cb, and 201Cc through which the cyan ink flows; ink channels 201Ma, 201Mb, and 201Mc through which the magenta ink flows; and ink channels 201Bka, 201Bkb, and 201Bkc through which the black ink flows. Arrangements of these channels when the ink jet head 103 is viewed from above are different from that of the ink channels 201Ya, 201Yb, and 201Yc. These channels, however, have cross-sectional configurations which are the same as those of the ink channels 201Ya, 201Yb, and 201Yc depicted in FIG. 8.

The ink channel 201Ca connects an internal space of the connection part 35Ca and the inlet 22Ca of the head chip 106B. The ink channel 201Cb connects an internal space of the connection part 35Cb and the inlet 22Cb of the head chip 106A. The ink channel 201Cc connects an internal space of the connection part 35Cc and the inlets 22Cb, 22Ca of the head chips 106B, 106A. The ink channel 201Ma connects an internal space of the connection part 35Ma and the inlet 22Ma of the head chip 106B. The ink channel 201Mb connects an internal space of the connection part 35MB and the inlet 22Mb of the head chip 106A. The ink channel 201Mc connects an internal space of the connection part 35Mc and the inlets 22Mb, 22Ma of the head chips 106B, 106A. The ink channel 201Bka connects an internal space of the connection part 35Bka and the inlet 22Bka of the head chip 106D. The ink channel 201Bkb connects an internal space of the connection part 35Bkb and the inlet 22Bkb of the head chip 106C. The ink channel 201Bkc connects an internal space of the connection part 35Bkc and the inlets 22Bkb, 22Bka of the head chips 106D, 106C.

In the ink-jet head 103 having the above configuration according to the first embodiment, the head chips 106A to 106D are arranged in parallel in the second direction, thus jetting ink densely and improving resolution.

In the ink jet head 103 according to the first embodiment, the ink channels 201Yc, 201Cc, 201Mc, and 201Bkc, those of which are formed between the head chips 106A and 106B adjacent to each other, branch off at parts downstream of the wiring substrate 400. This reduces the number of through holes in the wiring substrate 400.

Subsequently, an explanation will be made about through holes formed in the wiring substrate 400 with reference to FIGS. 10 and 18. In the following explanation, when distinctions between ink colors flowing through the ink channels and distinctions based on whether or not the ink channels branch off at parts downstream of the wiring substrate 400 are unnecessary, ink channels that penetrate through the wiring substrate 400 to be connected to the reservoirs 23 via the inlets 22 are simply referred to as "ink channels 201". Further, through holes formed in the wiring substrate 400 and through which the ink channels 201 run are collectively referred to as "through holes 47".

Figure 18:
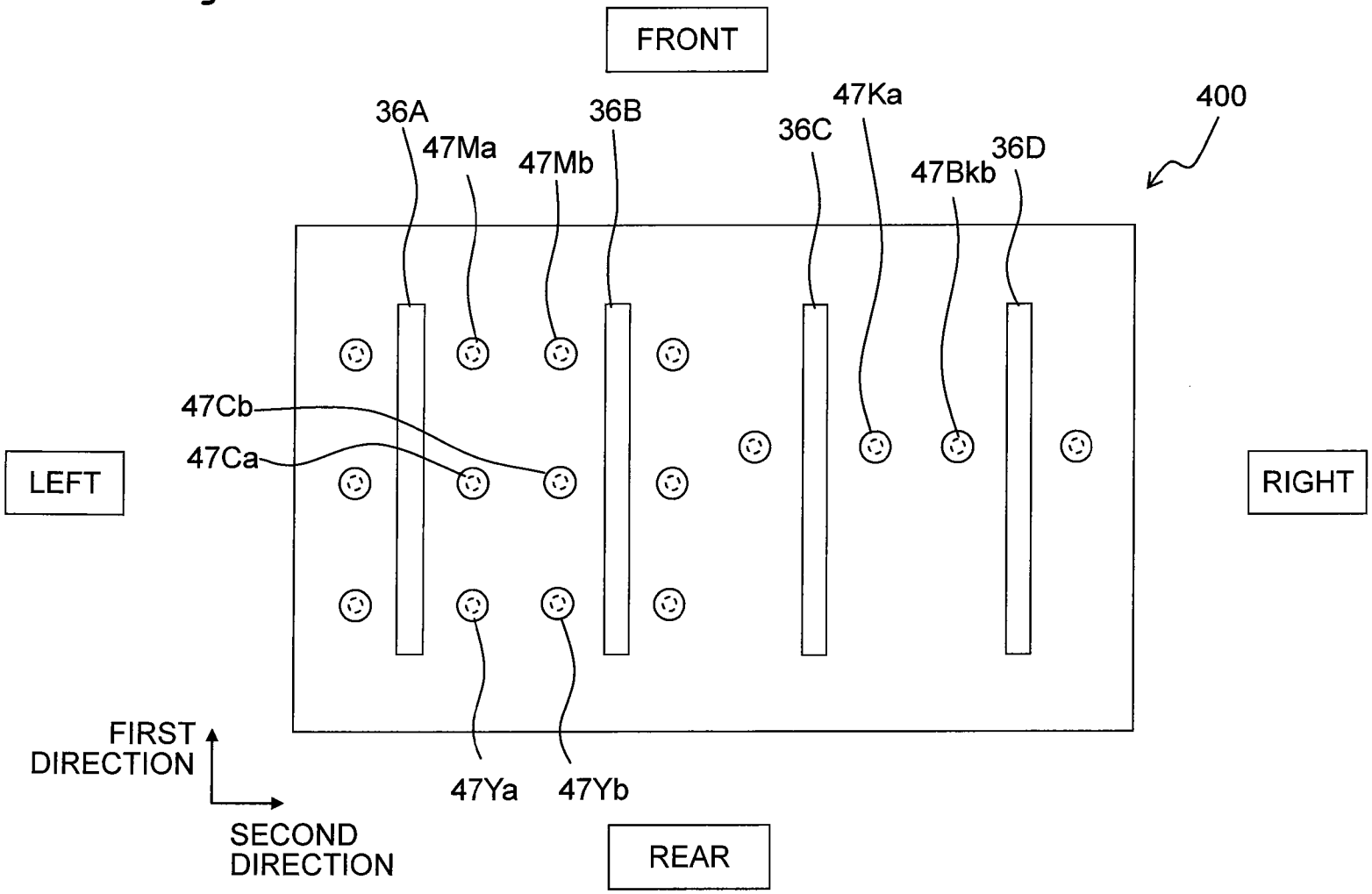
FIG. 18 is a bottom view of a wiring substrate that is used for comparison.

In a case of adopting an embodiment in which the ink channels 201 are provided while corresponding to the inlets 22 respectively, like conventional head chips, four ink channels 201 need to penetrate through the wiring substrate 400 for each of the four kinds of inks, as depicted in FIG. 18. Namely, 12 through holes 47 in all are required to be formed in the wiring substrate 400. Especially, six through holes 47 are formed in an area between the through holes 36A and 36B.

In the ink-jet head 103 according to the first embodiment, the ink channels 201Yc, 201Cc, 201Mc, and 201Bkc formed between the head chips 106A and 106B adjacent to each other branch off at parts downstream of the wiring substrate 400.

Thus, as depicted in FIG. 10, in the first embodiment, it is only required to provide the single through hole 47Yc between inlets 22Ya and 22Yb. This eliminates one through hole 47 for the yellow ink. Similarly, it is only required to provide the single through hole 47Cc between inlets 22Ca and 22Cb. This eliminates one through hole 47 for the cyan ink. Similarly, it is only required to provide the single through hole 47Mc between inlets 22Ma and 22Mb. This eliminates one through hole 47 for the magenta ink. Thus, it is possible to eliminate three through holes 47 in the area between the through hole 36A in which the flexible printed circuit board 70A is disposed and the through hole 36B in which the flexible printed circuit board 70B is disposed.

Between the through holes 36C and 36D, it is only required to provide the through hole 47Bkc between the inlets 22Bka and 22Bkb. This eliminates one through hole.

Reducing the number of through holes 47 in the wiring substrate 400 makes an arrangement area for wires in the wiring substrate 400 larger. In a case of narrowing distances between the head chips 106 adjacent to each other for the purpose of downsizing the ink-jet head 103, the through holes 47 are arranged densely in the wiring substrate 400, which may make it difficult to form wires in that area.

In the ink jet head 103 according to the first embodiment, however, the arrangement area for wires is large by reducing the number of through holes 47 in the wiring substrate 400, as described above. Thus, the four head chips 106 are arranged without increasing the ink jet head 103 in size.

In the first embodiment, the ink channel 201Yc formed between the head chips 106A and 106B adjacent to each other branches off in the downstream channel member 302. The present teaching, however, is not limited to this. The ink channel 201Yc may branch off in the downstream channel member 301 provided that the ink channel 201Yc branches off at a part downstream of the wiring substrate 400. Or, the ink channel 201Yc may branch off in the downstream channel member 303.

First Modified Embodiment

Subsequently, an explanation will be made about an ink-jet head 103 according to a first modified embodiment of the first embodiment with reference to FIGS. 11 and 12.

Figure 11:
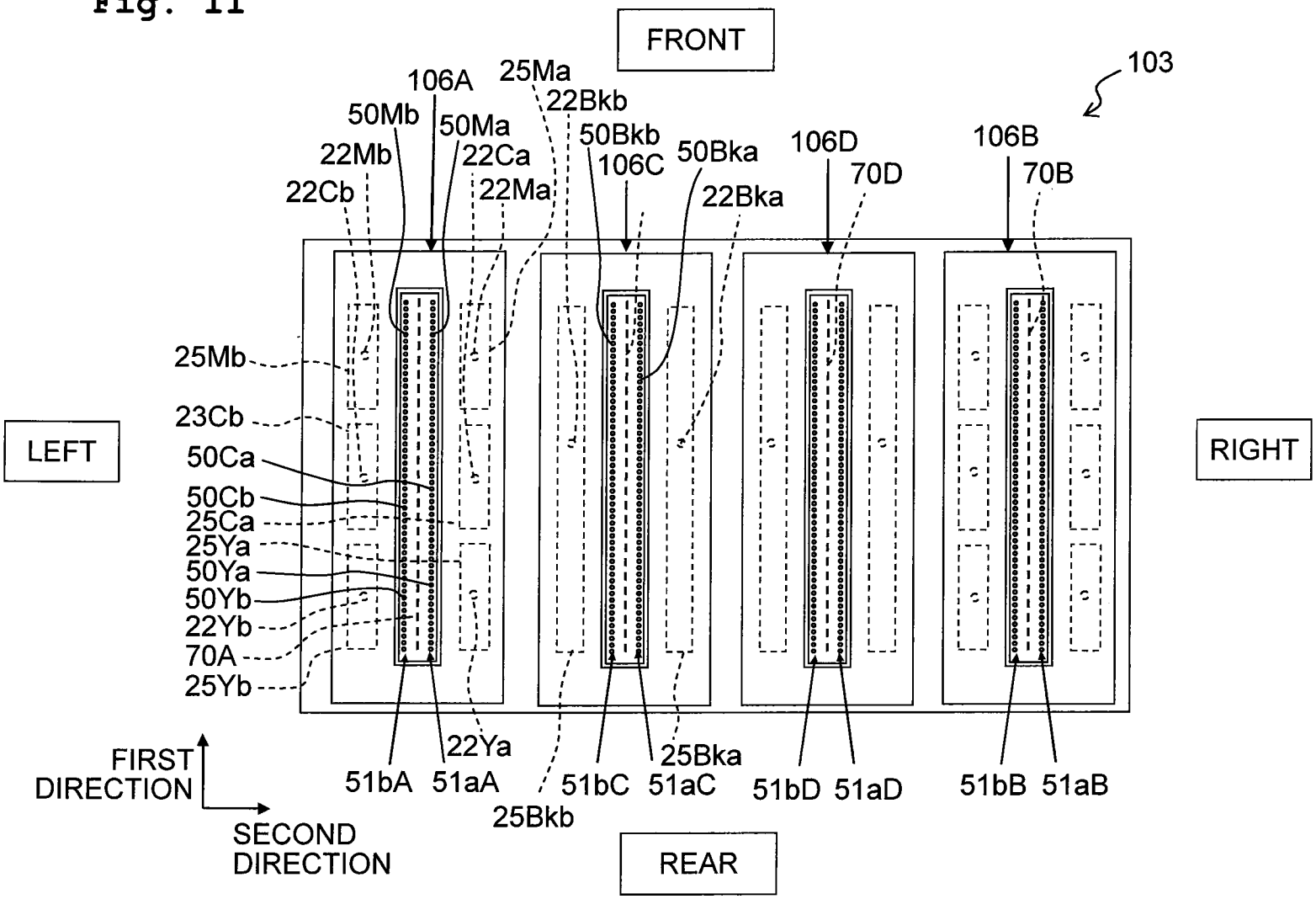
FIG. 11 is a bottom view of an ink-jet head according to a first modified embodiment of the first embodiment.
Figure 12:
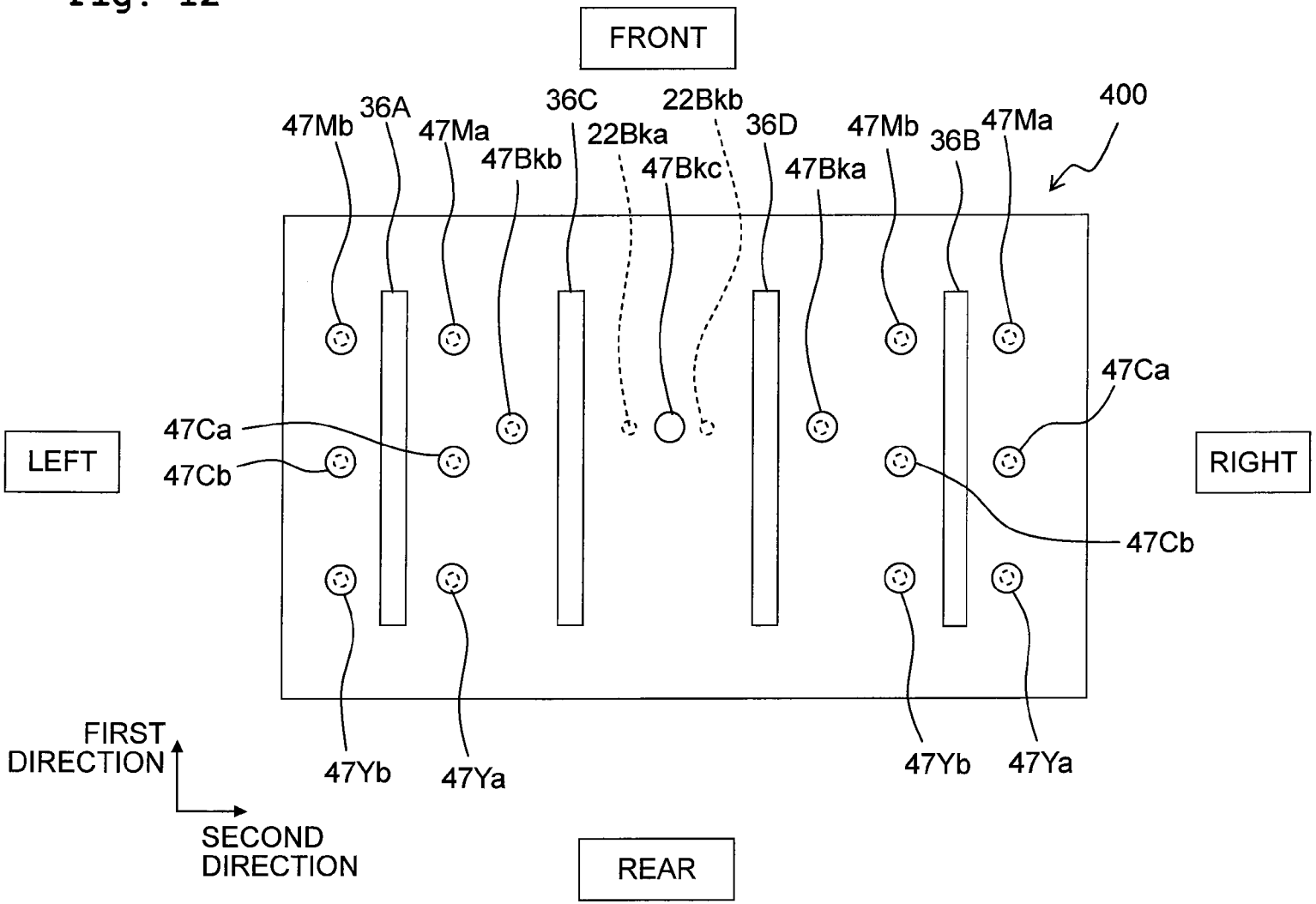
FIG. 12 is a bottom view of a wiring substrate of the ink-jet head according to the first modified embodiment of the first embodiment.

A first direction and second direction indicated in FIGS. 11 and 12 are defined similarly to those indicated in FIG. 1.

As depicted in FIG. 11, although the ink-jet head 103 according to the first modified embodiment has a basic configuration that is the same as that of the ink jet head 103 according to the first embodiment, the arrangement order of head chips 106A to 106D is different from that of the first embodiment. In the first modified embodiment, the head chips 106A, 106C, 106D, and 106B are arranged in that order from the left to the right in the second direction. The configurations of the head chips 106A to 106D according to the first modified embodiment are the same as those of the head chips 106A to 106D according to the first embodiment.

As depicted in FIG. 12, the wiring substrate 400 of the first modified embodiment is formed with four through holes 36A, 36C, 36D, and 36B arranged from the left to the right in the second direction. The through hole 36A is a through hole through which the flexible printed circuit board 70A connected to the head chip 106A is put, the through hole 36C is a through hole through which the flexible printed circuit board 70C connected to the head chip 106C is put, the through hole 36D is a through hole through which the flexible printed circuit board 70D connected to the head chip 106D is put, and the through hole 36B is a through hole through which the flexible printed circuit board 70B connected to the head chip 106B is put.

The through hole 47Bkc is formed between the through holes 36C and 36D. The through hole 47Bkc is a through hole 47 through which the ink channel 201, which is connected to the inlet 22Bka of the head chip 106C and the inlet 22Bkb of the head chip 106D, runs. As with the ink channel 201Yc described in the first embodiment, the ink channel 201 running through the through hole 47Bkc branches off at a part downstream of the wiring substrate 400 and connected to the inlet 22Bka of the head chip 106C and the inlet 22Bkb of the head chip 106D.

Four through holes 47Bkb, 47Ya, 47Ca, and 47Ma are formed between the through holes 36A and 36C. The ink channel 201 connected to the inlet 22Bka of the head chip 106C runs through the through hole 47Bkb, the ink channel 201 connected to the inlet 22Ya of the head chip 106A runs thorough the through hole 47Ya, the ink channel 201 connected to the inlet 22Ca of the head chip 106A runs thorough the through hole 47Ca, and the ink channel 201 connected to the inlet 22Ma of the head chip 106A runs thorough the through hole 47Ma.

Three through holes 47Yb, 47Cb, and 47Mb are formed in a left area of the through hole 36A. The ink channel 201 connected to the inlet 22Yb of the head chip 106A runs through the through hole 47Yb, the ink channel 201 connected to the inlet 22Cb of the head chip 106A runs through the through hole 47Cb, and the ink channel 201 connected to the inlet 22Mb of the head chip 106A runs through the through hole 47MbA.

Four through holes 47Bka, 47Yb, 47Cb, and 47Mb are formed between the through holes 36D and 36B. The ink channel 201 connected to the inlet 22Bka of the head chip 106D runs through the through hole 47Bka, the ink channel 201 connected to the inlet 22Yb of the head chip 106B runs thorough the through hole 47Yb, the ink channel 201 connected to the inlet 22Cb of the head chip 106B runs thorough the through hole 47Cb, and the ink channel 201 connected to the inlet 22Cb of the head chip 106B runs thorough the through hole 47Mb.

Three through holes 47Ya, 47Ca, and 47Ma are formed in a right area of the through hole 36B. The ink channel 201 connected to the inlet 22Ya of the head chip 106B runs through the through hole 47Ya, the ink channel 201 connected to the inlet 22Ca of the head chip 106B runs through the through hole 47Ca, and the ink channel 201 connected to the inlet 22Ma of the head chip 106B runs through the through hole 47Ma.

As with the ink channel 201Ya or 201Yb described in the first embodiment, 14 ink channels 201 running through 14 through holes 47 except the through hole 47Bkc do not branch off at parts downstream of the wiring substrate 400.

As with the ink-jet head 103 of the first embodiment, in the ink-jet head 103 of the first modified embodiment, the ink channel 201 formed between the head chips 106C and 106D branches off at a part downstream of the wiring substrate 400 to allow the inlet 22Bka of the head chip 106C to communicate with the inlet 22Bkb of the head chip 106D.

That configuration eliminates one through hole 47 in the wiring substrate 400, thus making the arrangement area for wires in the wiring substrate 400 larger. Thus, the four head chips 106 may be arranged in the ink-jet head 103 of the first modified embodiment without increasing the ink jet head 103 in size.

The ink-jet head 103 of the first modified embodiment is suitably used for bidirectional printing in serial printers, because the landing order of inks on a recording sheet is the same between printing performed when the carriage 102 moves from one end to the other end in the second direction and printing performed when the carriage 102 moves from the other end to one end in the second direction.

Second Embodiment

Figure 13:
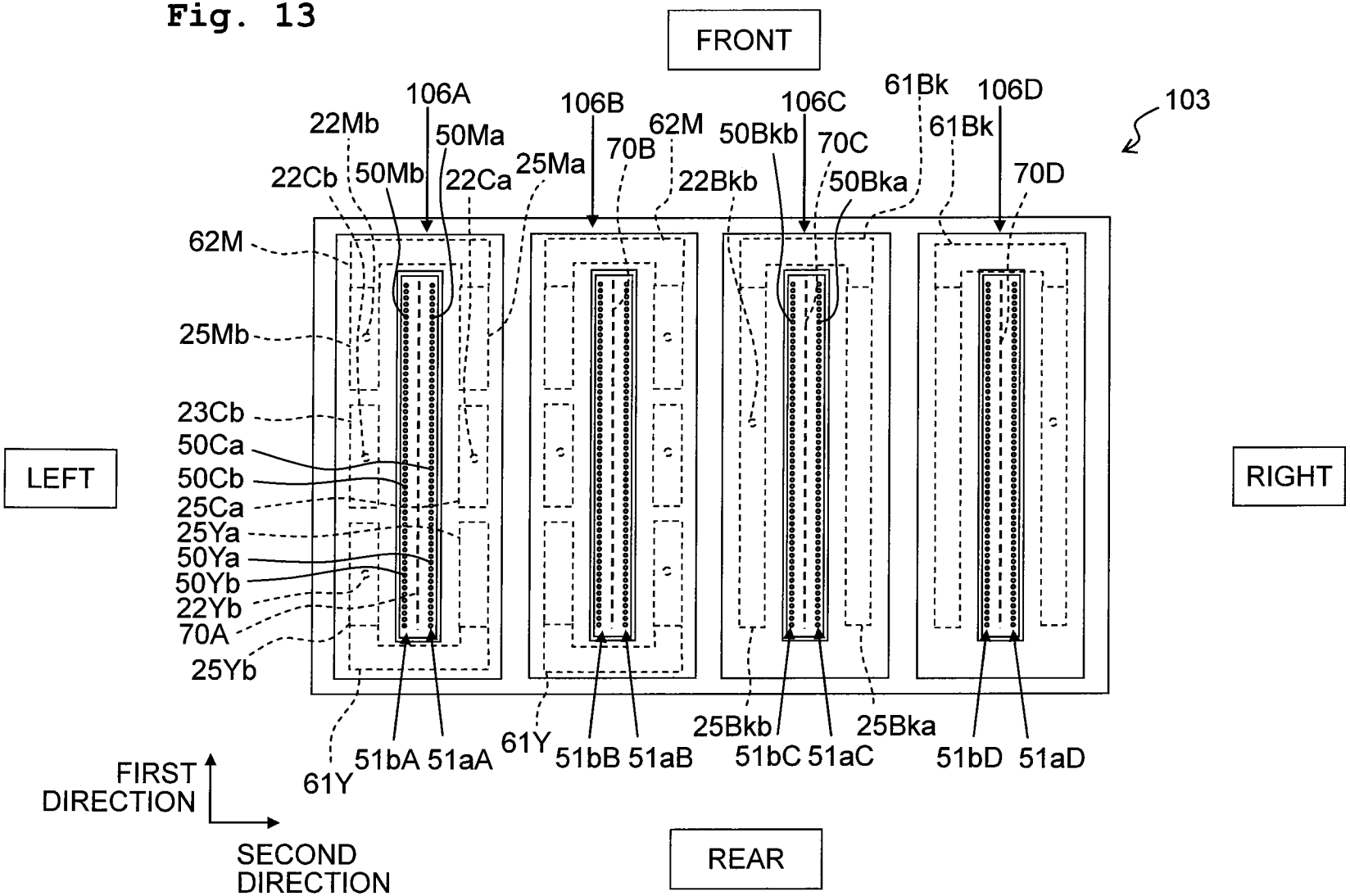
FIG. 13 is a bottom view of an ink jet head according to a second embodiment.

FIG. 13 is a bottom view of an ink-jet head according to a second embodiment. A first direction and second direction indicated in FIGS. 13 to 15 are defined similarly to those indicated in FIG. 1.

Figure 14:
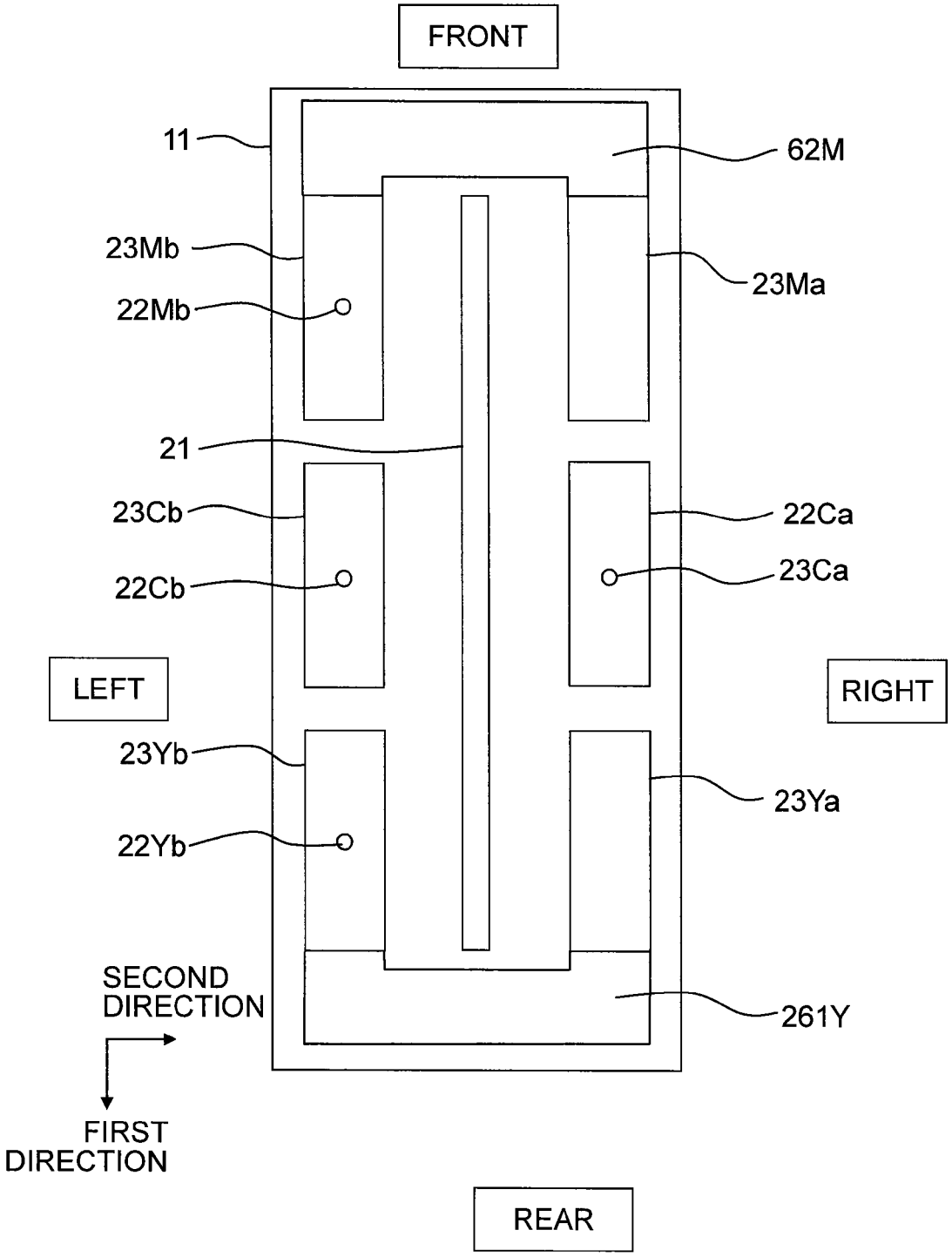
FIG. 14 is a bottom view of a reservoir formation member of a head chip of the ink jet head.
Figure 15:
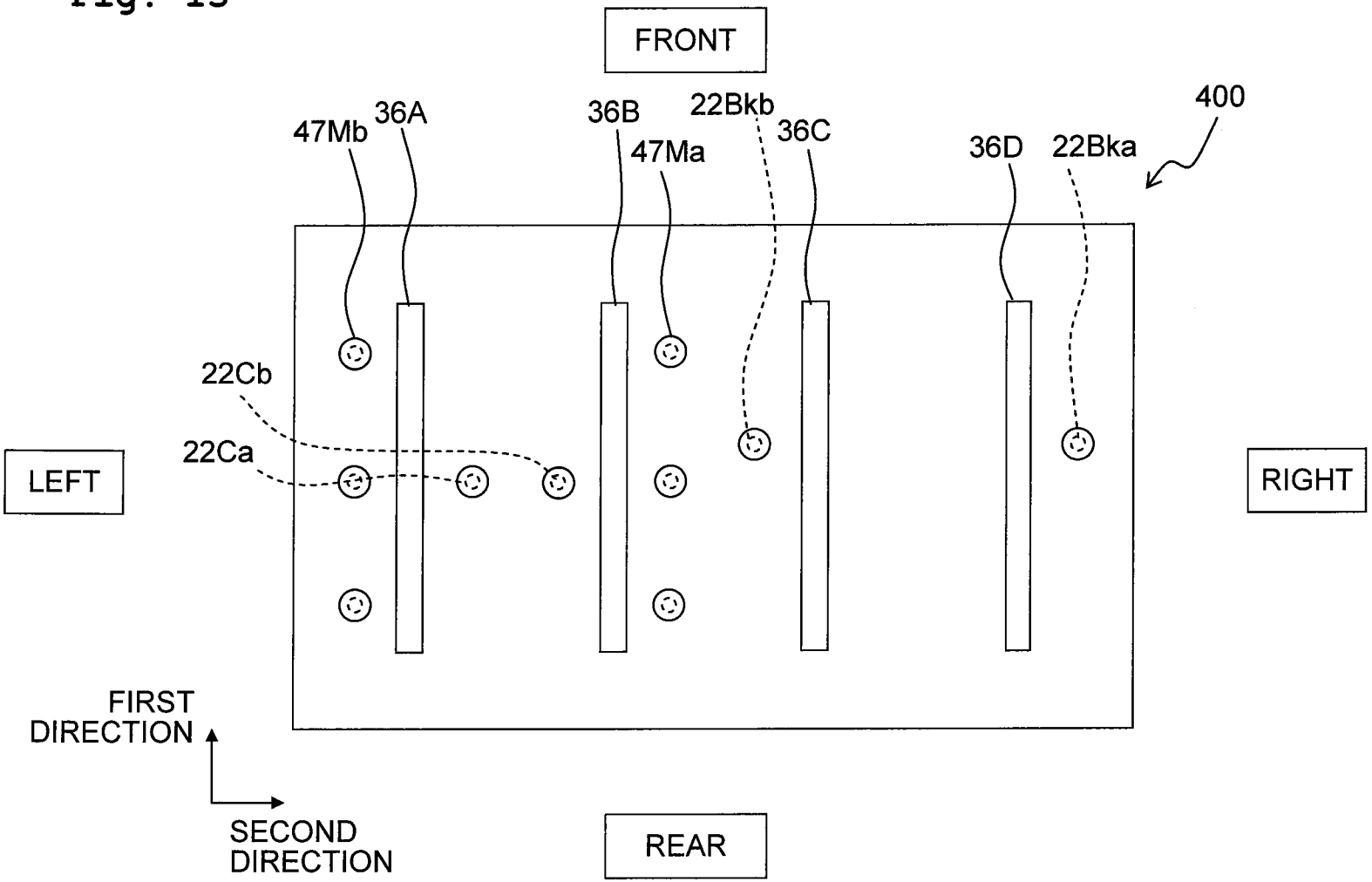
FIG. 15 is a bottom view of a wiring substrate of the ink-jet head according to the second embodiment.

As depicted in FIGS. 13 to 15, although an ink jet head 103 according to the second embodiment has a basic configuration that is the same as that of the ink-jet head 103 according to the first embodiment, each of the head chips 106A to 106D includes a connection channel connecting two reservoirs 23 facing each other with the flexible printed circuit board 70 intervened therebetween.

In particular, each of the head chips 106A and 106B includes a connection channel 61Y connecting the reservoirs 23Ya and 23Yb. The connection channel 61Y is formed to run around one end of the flexible printed circuit board 70A or the flexible printed circuit board 70B in the first direction. The connection channel 61Y is formed by a U-shaped groove formed in the lower surface of the reservoir formation member 11 and the upper surface of the channel formation substrate 14.

The head chip 106A has no inlet 22Ya communicating with the reservoir 23Ya of the head chip 106A, because ink in the reservoir 23Yb is supplied to the reservoir 23Ya through the connection channel 61Y. The head chip 106B has no inlet 22Yb communicating with the reservoir 23Yb of the head chip 106B, because ink in the reservoir 23Ya is supplied to the reservoir 23Yb through the connection channel 61Y.

In the head chip 106A according to the second embodiment, the ink channel 201 communicating with the inlet 22Ya is eliminated and the through hole 47 through which the ink channel 201 runs is eliminated from the wiring substrate 400. In the head chip 106B according to the second embodiment, the ink channel 201 communicating with the inlet 22Yb is eliminated and the through hole 47 through which the ink channel 201 runs is eliminated from the wiring substrate 400.

Each of the head chips 106A and 106B includes a connection channel 62M connecting the inlets 22Ma and 22Mb. The connection channel 62M is formed to run around the other end of the flexible printed circuit board 70A or the flexible printed circuit board 70B in the first direction. The connection channel 62M is formed by a U-shaped groove formed in the lower surface of the reservoir formation member 11 and the upper surface of the channel formation substrate 14.

The head chip 106A has no inlet 22Ma communicating with the reservoir 23Ma of the head chip 106A, because ink in the reservoir 23Mb is supplied to the reservoir 23Ma through the connection channel 62M. The head chip 106B has no inlet 22Mb communicating with the reservoir 23Mb of the head chip 106B, because ink in the reservoir 23Ma is supplied to the reservoir 23Mb through the connection channel 62M.

In the head chip 106A according to the second embodiment, the ink channel 201 communicating with the inlet 22Ma is eliminated and the through hole 47 through which the ink channel 201 runs is eliminated from the wiring substrate 400. In the head chip 106B according to the second embodiment, the ink channel 201 communicating with the inlet 22Mb is eliminated and the through hole 47 through which the ink channel 201 runs is eliminated from the wiring substrate 400.

In the second embodiment, the inlet 22Ya of the head chip 106A and the inlet 22Yb of the head chip 106B that are adjacent to each other are not provided. Further, in the second embodiment, the inlet 22Ma of the head chip 106A and the inlet 22Mb of the head chip 106B that are adjacent to each other are not provided.

Thus, even when a distance between the head chips 106A and 106B is short, the through holes 47 are not densely formed in the area of the wiring substrate 400 between the head chips 106A and 106B, thus resulting in a sufficient space for wires.

Each of the head chips 106C and 106D includes a connection channel 61Bk connecting the reservoirs 23Bka and 23Bkb. The connection channel 61Bk is formed to run around one end of the flexible printed circuit board 70C or the flexible printed circuit board 70D in the first direction. The connection channel 61Bk is formed by a U-shaped groove formed in the lower surface of the reservoir formation member 11 and the upper surface of the channel formation substrate 14.

The head chip 106C has no inlet 22Bka communicating with the reservoir 23Bka, because ink in the reservoir 23Bkb is supplied to the reservoir 23Bka through the connection channel 61Bk. The head chip 106D has no inlet 22Bkb communicating with the reservoir 23Bkb, because ink in the reservoir 23Bka is supplied to the reservoir 23Bkb through the connection channel 61Bk.

In the head chip 106C according to the second embodiment, the ink channel 201 communicating with the inlet 22Bka is eliminated and the through hole 47 through which the ink channel 201 runs is eliminated from the wiring substrate 400. In the head chip 106D according to the second embodiment, the ink channel 201 communicating with the inlet 22Bkb is eliminated and the through hole 47 through which the ink channel 201 runs is eliminated from the wiring substrate 400.

In the second embodiment, the head chip 106C has no inlet 22Bka and the head chip 106D has no inlet 22Bkb. Thus, even when a distance between the head chips 106C and 106D is short, the through holes 47 are not densely formed in the area of the wiring substrate 400 between the head chips 106C and 106D, thus resulting in a sufficient space for wires.

The ink-jet head 103 according to the second embodiment configured as described above includes, in each of the head chips 106, the connection channel 61 connecting the two reservoirs 23 arranged to face each other with the flexible printed circuit board 70 intervened therebetween. This makes it possible to supply ink from one of the two reservoirs 23 to the other of the two reservoirs 23 without any inlet 22 communicating with the other of the two reservoirs 23.

Thus, it is possible to reduce the number of ink channels 201 communicating with the inlets 22, thus making it possible to reduce the number of through holes 47 through which the ink channels run.

Accordingly, in the ink-jet head 103 according to the second embodiment, the number of through holes 47 in the wiring substrate 400 may be reduced to increase the arrangement area for the wires in the wiring substrate 400. Namely, the four head chips 106A to 106D may be arranged without increasing the ink-jet head 103 in size.

Further, in the ink jet head 103 according to the second embodiment, the connection channel 61 is formed in the reservoir formation member 11. In some cases, the U-shaped groove connecting the two reservoirs 23 may be formed not only in the reservoir formation member 11 but also in the channel formation substrate 14 to connect the two reservoirs 23 facing each other with the flexible printed circuit board 70 intervened therebetween. However, when the U-shaped groove is formed in the channel formation substrate 14 having a small thickness to run around the flexible printed circuit board 70, the channel formation substrate 14 may decrease in strength. Since the channel formation substrate 14 according to the second embodiment has no U-shaped groove connecting the two reservoirs 23, the channel formation substrate 14 is prevented from decreasing in strength and thus it increases in yield.

The second embodiment adopts the embodiment in which the connection channel 61Bk is formed to run around one end of the flexible printed circuit board 70 in the first direction. The present teaching, however, is not limited to the above-described embodiment. For example, the connection channels 61Bk may be formed at one end and the other end of the reservoir formation member 11 in the first direction to run around the flexible printed circuit board 70, respectively.

Second Modified Embodiment

An explanation will be made about an ink jet head 103 according to a second modified embodiment of the second embodiment with reference to FIGS. 16 and 17.

Figure 16:
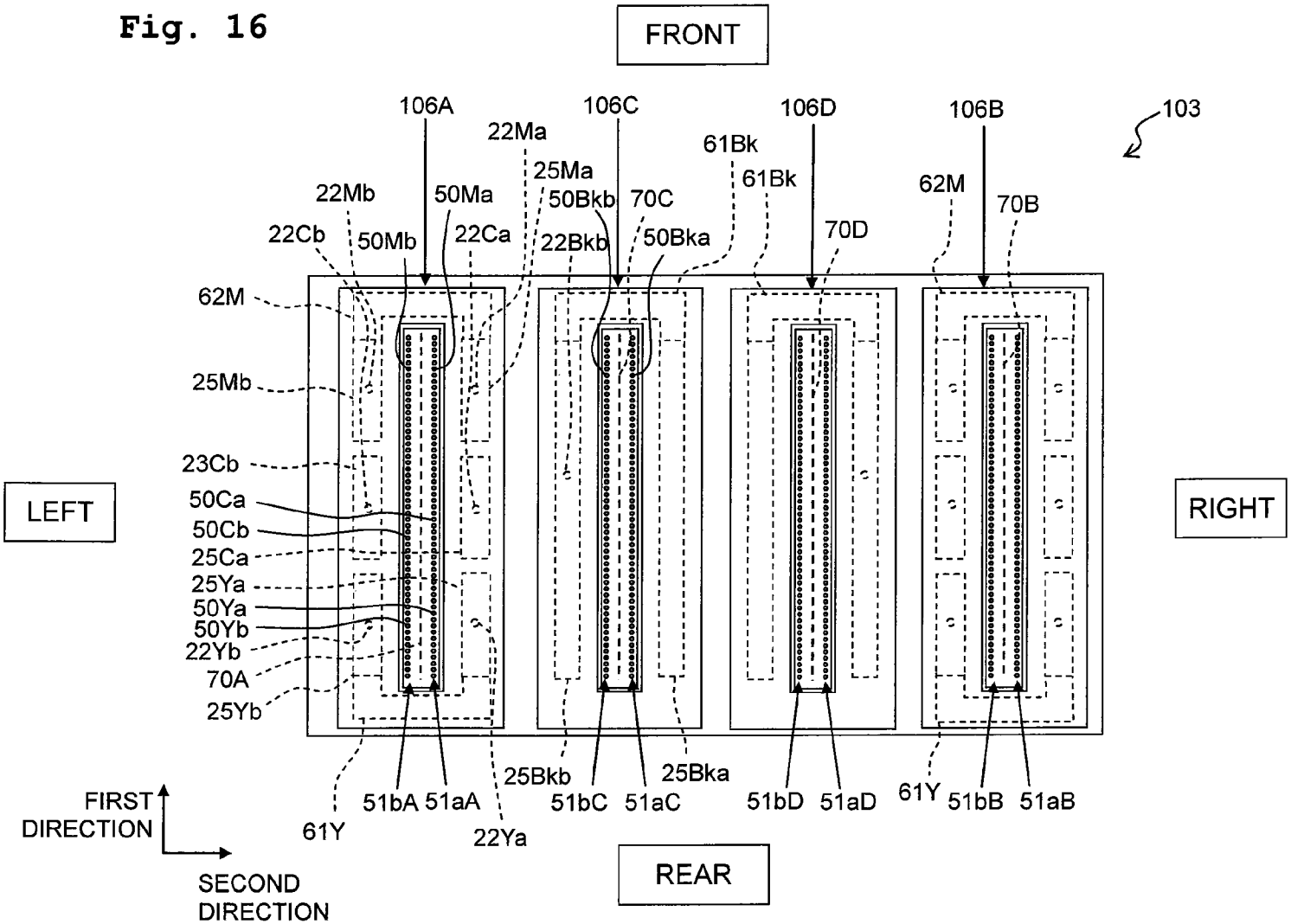
FIG. 16 is a bottom view of an ink jet head according to a second modified embodiment of the second embodiment.
Figure 17:
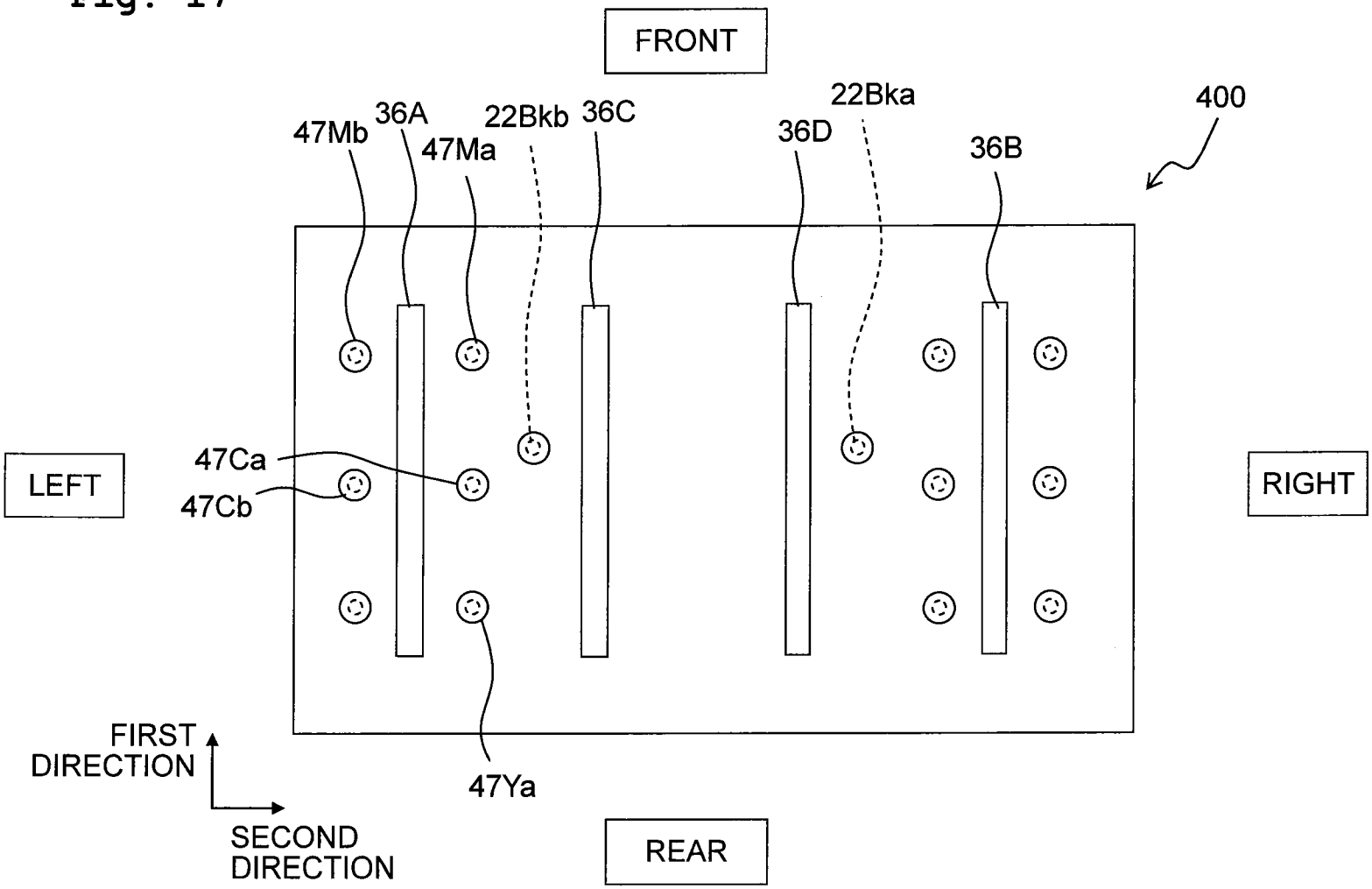
FIG. 17 is a bottom view of a wiring substrate of the ink jet head according to the second modified embodiment of the second embodiment.

A first direction and second direction indicated in FIGS. 16 and 17 are defined similarly to those indicated in FIG. 1.

As depicted in FIGS. 16 and 17, the arrangement order of head chips 106A to 106D in the ink-jet head 103 of the second modified embodiment is different from that of the second embodiment. In the second modified embodiment, the head chips 106A, 106C, 106D, and 106B are arranged in that order from the left to the right in the second direction. The configurations of the head chips 106A to 106D according to the second modified embodiment are the same as those of the head chips 106A to 106D according to the second embodiment.

As with the ink-jet head 103 according to the second embodiment, in the ink-jet head 103 according to the second modified embodiment, the connection channel 61 connecting two reservoirs 23 facing each other with the flexible printed circuit board 70 sandwiched therebetween is formed in each of the head chips 106. Thus, it is possible to supply ink from one of the two reservoirs 23 to the other of the two reservoirs 23 without providing the inlet 22 communicating with the other of the two reservoirs 23.

Thus, there is no need to provide the ink channel 201 communicating with the inlet 22 for the other of the two reservoirs 23, and there is no need to provide in the wiring substrate 400 the through hole 47 through which the ink channel 201 runs.

Accordingly, the number of through holes 47 in the wiring substrate 400 may be reduced to make the arrangement area for wires in the wiring substrate 400 larger in the ink jet head 103 according to the second modified embodiment. Thus, the four head chips 106 may be arranged in the ink jet head 103 of the second modified embodiment without increasing the ink jet head 103 in size.

The above description allows those skilled in the art to have many modifications and any other embodiments of the present teaching. Thus, the above description should be interpreted as just examples, and is provided to teach those skilled in the art the best mode for carrying out the present teaching. Details about the configurations and/or the functions described above may be substantially changed without departing from the gist and scope of the present teaching. Further, a variety of teaching may be created by combining the components or parts disclosed in the above embodiments as appropriate.

What is claimed is:

1. An ink-jet head configured to jet a first ink, a second ink, a third ink, and a fourth ink, the ink-jet head comprising:

a first head chip including two first nozzle arrays extending in a first direction, the first nozzle arrays including first nozzles corresponding to the first ink, second nozzles corresponding to the second ink, and third nozzles corresponding to the third ink;

a second head chip including two second nozzle arrays extending in the first direction, the second nozzle arrays including first nozzles corresponding to the first ink, second nozzles corresponding to the second ink, and third nozzles corresponding to the third ink;

a third head chip including two third nozzle arrays extending in the first direction, the third nozzle arrays including fourth nozzles corresponding to the fourth ink; and a fourth head chip including two fourth nozzle arrays extending in the first direction, the fourth nozzle arrays including fourth nozzles corresponding to the fourth ink, wherein the first head chip to the fourth head chip are arranged side by side in a second direction orthogonal to the first direction;

wherein one of the first, second, third, and fourth head chips includes a first flexible printed circuit board connected at a position between the respective two nozzle of the one of the first, second, third, and fourth head chips arrays in the second direction;

wherein another of the first, second, third, and fourth head chips includes a second flexible printed circuit board connected at a position between the respective two nozzle of the another of the first, second, third, and fourth head chips arrays in the second direction; and wherein the ink-jet head further includes a wiring substrate connected to the first and second flexible printed circuit boards.

2. The ink-jet head according to claim 1, wherein the first head chip includes the first flexible printed circuit board connected at a position between the two first nozzle arrays in the second direction;

the second head chip includes the second flexible printed circuit board connected at a position between the two first nozzle arrays in the second direction;

the third head chip includes a third flexible printed circuit board connected at a position between the two second nozzle arrays in the second direction;

the fourth head chip includes a fourth flexible printed circuit board connected at a position between the two second nozzle arrays in the second direction; and the wiring substrate is connected to the first, second, third, and fourth flexible printed circuit boards.

3. The ink-jet head according to claim 2, wherein the first head chip and the second head chip are arranged adjacent to each other.

4. The ink-jet head according to claim 3, further comprising a channel member formed with an ink channel which allows the first head chip to communicate with the second head chip, wherein the wiring substrate includes a through hole through which the ink channel runs, the first head chip includes a first reservoir and a first communication port, the first reservoir communicating with a first nozzle, of the first nozzles, that is arranged closer to the second head chip than the first flexible printed circuit board, the first communication port communicating with the first reservoir and being arranged closer to the second head chip than the first flexible printed circuit board;

the second head chip includes a second reservoir and a second communication port, the second reservoir communicating with a first nozzle, of the first nozzles, that is arranged closer to the first head chip than the second flexible printed circuit board, the second communication port communicating with the second reservoir and being arranged closer to the first head chip than the second flexible printed circuit board;

the ink channel includes a common channel running through the through hole and two branch channels branching from the common channel between the wiring substrate and the first and second head chips, and one of the two branch channels is connected to the first communication port, and the other of the two branch channels is connected to the second communication port.

5. The ink-jet head according to claim 2, wherein the third head chip and the fourth head chip are arranged adjacent to each other.

6. The ink-jet head according to claim 5, further comprising a channel member formed with an ink channel which allows the third head chip to communicate with the fourth head chip, wherein the wiring substrate includes a through hole through which the ink channel runs, the third head chip includes a third reservoir and a third communication port, the third reservoir communicating with a fourth nozzle, of the fourth nozzles, that is arranged closer to the fourth head chip than the third flexible printed circuit board, the third communication port communicating with the third reservoir and being arranged closer to the fourth head chip than the third flexible printed circuit board;

the fourth head chip includes a fourth reservoir and a fourth communication port, the fourth reservoir communicating with a fourth nozzle, of the fourth nozzle, that is arranged closer to the third head chip than the fourth flexible printed circuit board, the fourth communication port communicating with the fourth reservoir and being arranged closer to the third head chip than the fourth flexible printed circuit board;

the ink channel includes a common channel running through the through hole and two branch channels branching from the common channel between the wiring substrate and the third and fourth head chips, and one of the two branch channels is connected to the third communication port, and the other of the two branch channels is connected to the fourth communication port.

7. The ink-jet head according to claim 5, wherein the first head chip, the third head chip, the fourth head chip, and the second head chip are arranged in that order.

8. The ink-jet head according to claim 2, wherein the first head chip includes a reservoir formation member formed with a first reservoir communicating with one first nozzle, of the first nozzles, that is arranged at one side in the second direction, a second reservoir communicating with another first nozzle, of the first nozzles, that is arranged at the other side in the second direction, and a connection channel connecting the first reservoir and the second reservoir, the reservoir formation member includes a through hole through which the first flexible printed circuit board is put, and the connection channel connects the first reservoir and the second reservoir to run around the first flexible printed circuit board at one end side in the first direction.

9. The ink-jet head according to claim 8, wherein the reservoir formation member includes a first reservoir formation member made from resin and a plate-shaped second reservoir formation member made from silicon, and the connection channel is defined by a groove formed in the first reservoir formation member and a surface of the second reservoir formation member.

10. The ink-jet head according to claim 8, wherein the one first nozzle arranged at the one side in the second direction, another first nozzle arranged at the other side in the second direction, the first reservoir, and the second reservoir are arranged at the one end side in the first direction.

11. The ink-jet head according to claim 8, further comprising a channel member formed with an ink channel communicating with the first head chip, wherein the wiring substrate includes a through hole through which the ink channel runs, the reservoir formation member includes a communication port communicating with the first reservoir, and the ink channel running through the through hole is connected to the communication port communicating with the first reservoir.

12. The ink-jet head according to claim 11, wherein the first head chip, the third head chip, the fourth head chip, and the second head chip are arranged in order.

13. The ink-jet head according to claim 12, wherein the communication port and the ink channel are arranged at a side more distant from the first flexible printed circuit board than the third head chip.

14. The ink-jet head according to claim 2, wherein the third head chip includes a reservoir formation member formed with a first reservoir communicating with one fourth nozzle, of the fourth nozzles, that is arranged at one side in the second direction, a second reservoir communicating with another fourth nozzle, of the fourth nozzles, that is arranged at the other side in the second direction, and a connection channel connecting the first reservoir and the second reservoir, the reservoir formation member includes a through hole through which the third flexible printed circuit board is put, and the connection channel connects the third reservoir and the fourth reservoir to run around the third flexible printed circuit board at one end side in the first direction.

15. The ink-jet head according to claim 14, wherein the reservoir formation member includes a first reservoir formation member made from resin and a plate-shaped second reservoir formation member made from silicon, and the connection channel is defined by a groove formed in the first reservoir formation member and a surface of the second reservoir formation member.

16. The ink-jet head according to claim 15, further comprising a channel member formed with an ink channel communicating with the third head chip, wherein the wiring substrate includes a through hole through which the ink channel runs, the reservoir formation member includes a communication port communicating with the third reservoir, and the ink channel running through the through hole is connected to the communication port communicating with the third reservoir.

17. The ink-jet head according to claim 1, wherein the first nozzle arrays to the fourth nozzle arrays are configured to form an image of 250 to 400 dpi by use of each of the nozzle arrays and an image of 1,000 to 1,600 dpi during one pass.

18. The ink-jet head according to claim 17, wherein, in four nozzle arrays including two nozzle arrays formed by the first nozzles of the two first nozzle arrays and two nozzle arrays formed by the first nozzles of the two second nozzle arrays, each of the nozzle arrays includes the first nozzles which are arrayed to be separated by an identical pitch P and the four nozzle arrays are arranged to deviate from each other by P/4, in four nozzle arrays including two nozzle arrays formed by the second nozzles of the two first nozzle arrays and two nozzle arrays formed by the second nozzles of the two second nozzle arrays, each of the nozzle arrays includes the second nozzles which are arrayed to be separated by the identical pitch P and the four nozzle arrays are arranged to deviate from each other by P/4, in four nozzle arrays including two nozzle arrays formed by the third nozzles of the two first nozzle arrays and two nozzle arrays formed by the third nozzles of the two second nozzle arrays, each of the nozzle arrays includes the third nozzles which are arrayed to be separated by the identical pitch P and the four nozzle arrays are arranged to deviate from each other by P/4, and in four nozzle arrays including the two third nozzle arrays and the two fourth nozzle arrays, each of the nozzle arrays includes the fourth nozzles which are arrayed to be separated by the identical pitch P and the four nozzle arrays are arranged to deviate from each other by P/4.

* * * * *